US008792805B2

(12) United States Patent
Takayama

(10) Patent No.: US 8,792,805 B2
(45) Date of Patent: Jul. 29, 2014

(54) COLOR ELECTROPHOTOGRAPHIC IMAGE FORMING APPARATUS

(75) Inventor: Akinori Takayama, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 416 days.

(21) Appl. No.: 12/724,908

(22) Filed: Mar. 16, 2010

(65) Prior Publication Data

US 2010/0239314 A1 Sep. 23, 2010

(30) Foreign Application Priority Data

Mar. 19, 2009 (JP) ..... 2009-067350

(51) Int. Cl.
*G03G 21/16* (2006.01)
*G03G 21/18* (2006.01)

(52) U.S. Cl.
CPC ..... *G03G 21/1842* (2013.01); *G03G 21/1821* (2013.01); *G03G 2221/1869* (2013.01)
USPC ..... 399/111

(58) Field of Classification Search
CPC ..... G03G 21/1821; G03G 21/1842; G03G 2221/1869; G03G 15/0189; G03G 21/1619; G03G 21/18; G03G 21/1807; G03G 21/1839; G03G 2221/183
USPC ..... 399/111, 112
See application file for complete search history.

(56) References Cited

U.S. PATENT DOCUMENTS

| | | | | |
|---|---|---|---|---|
| 5,303,018 | A * | 4/1994 | Terada et al. | 399/299 |
| 5,608,498 | A | 3/1997 | Nagase et al. | |
| 6,708,011 | B2 | 3/2004 | Nomura et al. | |
| 7,664,428 | B2 * | 2/2010 | Kei | 399/110 |
| 2007/0071494 | A1 | 3/2007 | Igarashi et al. | |
| 2008/0159772 | A1 * | 7/2008 | Koishi et al. | 399/90 |
| 2008/0159773 | A1 | 7/2008 | Murayama et al. | |
| 2009/0092412 | A1 * | 4/2009 | Kei | 399/110 |
| 2009/0129812 | A1 * | 5/2009 | Kawanami et al. | 399/111 |

* cited by examiner

*Primary Examiner* — Walter L Lindsay, Jr.
*Assistant Examiner* — Benjamin Schmitt
(74) *Attorney, Agent, or Firm* — Fitzpatrick, Cella, Harper & Scinto

(57) ABSTRACT

A color electrophotographic image forming apparatus for forming an image on a recording material includes a cartridge supporting member movable between an inside position inside a main assembly of the apparatus while supporting cartridges and an outside position outside the main assembly of the apparatus. The apparatus includes a plurality of positioning urging devices that urge the cartridges to positioning portions, and a plurality of spacing urging devices that urge the cartridges in directions of spacing from the positioning portions. The urging forces of the plurality of spacing urging devices are smaller than a combination of an urging force of the plurality of positioning urging devices and forces applied to the plurality of spacing urging devices by weights of the cartridges.

7 Claims, 25 Drawing Sheets

(a)

(b)

(a)

(b)

(a)

(b)

(a)

(b)

COLOR ELECTROPHOTOGRAPHIC IMAGE FORMING APPARATUS

FIELD OF THE INVENTION AND RELATED ART

The present invention relates to a color electrophotographic image forming apparatus, wherein a plurality of cartridges are dismountably mounted to a main assembly, and an image is formed on a recording material.

Here, here, the color electrophotographic image forming apparatus forms a color image on a recording material using an electrophotographic image forming process. The examples of the color electrophotographic image forming apparatus include a color electrophotographic copying machine, a color electrophotographic printer (color laser beam printer, color LED printer, for example), a color facsimile device, and a color word processor.

The image is formed by the electrophotographic image forming apparatus on a recording material, and the recording material is paper, an OHP sheet, for example.

The cartridge is a process cartridge, a developing cartridge or the like and contributes to an image forming process for forming the image on the recording material in the state that it is mounted to the main assembly of the electrophotographic image forming apparatus. Here, the process cartridge contains at least one of charging means, developing means, cleaning means which are process means, and the electrophotographic photosensitive drum, all as a unit integrally, and the process cartridge is dismountably mountable to the main assembly of the electrophotographic image forming apparatus. The process cartridge may contain the developing means as the process means and the electrophotographic photosensitive drum, all as a unit, and it is dismountably mountable to the main assembly of the electrophotographic image forming apparatus. The process cartridge may contain the charging means, the developing means, or the cleaning means as the process means and the electrophotographic photosensitive drum, all as a unit, and it is dismountably mountable to the main assembly. The process cartridge which is provided integrally with the electrophotographic photosensitive drum and the developing means is called an integral-type process cartridge. The process cartridge which is provided integrally with the electrophotographic photosensitive drum and the process means other than the developing means is called a discrete type process cartridge.

The process cartridge can be mounted to and dismounted from the main assembly of the image forming apparatus. For this reason, the maintenance of the apparatus is easy. The process means acts on the electrophotographic photosensitive drum.

The developing cartridge is provided with a developing roller, and accommodates a developer (toner) to be used for developing an electrostatic latent image formed on the electrophotographic photosensitive drum by the developing roller, and it is dismountably mounted to the main assembly. In the case of the developing cartridge, the electrophotographic photosensitive drum is mounted to the main assembly or to the cartridge supporting member, as will be described hereinafter. Or, the electrophotographic photosensitive drum is provided in a so-called discrete type process cartridge, and in this case, the process cartridge is not provided with the developing means. The developing cartridge is also mounted and demounted relative to the main assembly of the image forming apparatus by the user. For this reason, the maintenance of the apparatus is easy.

Therefore, the cartridge in this invention includes the process cartridges of a so-called the integral type and a so-called discrete type. The cartridge includes a combination of the so-called process cartridge of the discrete type and the developing cartridge. In another example of the cartridge, the electrophotographic photosensitive drum is mounted fixedly to the main assembly or the cartridge supporting member which will be described hereinafter, and the detachably mountable developing cartridge acts on the electrophotographic photosensitive drum.

INVENTION

As for the structure for mounting and demounting of the cartridge relative to the main assembly of an image forming apparatus, the following structures are known.

The cartridge is supported by the cartridge supporting member raised and lowered while being moved back and forth in interrelation with an opening and closing member. By opening the opening and closing member, the cartridge supporting member is moved, and the cartridge is moved from an image forming position to a drawn-out position. Thereafter, the cartridge supported by the cartridge supporting member is directly drawn out of the main assembly. A drawing operation of this moves the cartridge supporting member to a predetermined position. In this manner, each cartridge is mounted and demounted, and clearance of the jammed paper or sheet is enabled (U.S. Pat. No. 5,608,498).

A plurality of cartridge is contained in the cartridge supporting member in the form of the case with a recording material holding belt. In the state that the cartridge supporting member is drawn from the main assembly to a front side, the cartridges are exchanged (U.S. Pat. No. 6,708,011).

Furthermore, the cartridge supporting member which contains the cartridges is drawn out of a main assembly casing to the front side, so that each cartridge is moved to the exchanging position. Or, the cartridge supporting member further moves upwardly away from a drawing direction. By this, the cartridge supporting member which contains the cartridges can be disengaged from the main assembly casing (USP2007/0071494).

With the structure as described above, the operativity of the maintenance of the exchange of the cartridge and the clearance of a jammed sheet or the like is improved.

SUMMARY OF THE INVENTION

However, in order to prevent a rubbing with a belt to which the cartridge is in contact and a transfer roller or the like, in the cartridge and an inside of the main assembly in this case, it is preferable that the cartridge is spaced from a positioning portion in the main assembly.

In the above-described conventional example, an opening and closing operation of the opening and closing member and a movement of the cartridge supporting member are interrelated, or a user operates the cartridge supporting member directly. By this, the cartridge is spaced from the positioned place in the main assembly 100*a*. Or, the cartridge supporting member is drawn from the main assembly, and the cartridge is drawn to the outside of the main assembly together with the belt.

The present invention further develops the prior art described above.

It is an object of the present invention to provide a color electrophotographic image forming apparatus, wherein the cartridge supporting member is used and the required force in the case of the cartridge exchange by the user is reduced.

It is another object of the present invention to provide a color electrophotographic image forming apparatus, wherein the cartridge supporting member is used and the operativity of the maintenance is further improved.

According to an aspect of the present invention, there is provided a color electrophotographic image forming apparatus for forming an image on a recording material, wherein a plurality of cartridges are detachably mountable to a main assembly of the apparatus, said apparatus comprising a cartridge supporting member movable between an inside position inside said main assembly of the apparatus while supporting said cartridge and an outside position outside said main assembly of the apparatus; an opening for permitting said cartridge supporting member between the inside position and the outside position; an openable member movable between a close position for closing said opening and an open position for opening said opening; positioning urging means for urging in said of positioning said cartridge to a positioning portion of said main assembly of the apparatus by closing said openable member and for releasing said cartridge from the urging by opening said openable member; and spacing urging means for urging said cartridge in a direction of spacing from the positioning portion; wherein an urging force of said spacing urging means is smaller than a resultant force of an urging force of said positioning urging means and a force applied to said spacing urging means by a weight said cartridge and is larger than the force applied to said spacing urging means by the weight said cartridge.

In the present invention, in the structure which uses the cartridge supporting member, a required force when the user exchanges the cartridge can be reduced. In the present invention, in the structure which uses the cartridge supporting member, the maintenance operativity is improved. In the present invention, only by carrying out the operation which opens the opening and closing member, the positioning, to the main assembly, of the cartridge is released, and the cartridge is spaced from the positioning portion of the main assembly without using a complicated mechanism. In this case, the cartridge released in the positioning is spaced from the positioning portion of the main assembly by the urging force of the spacing and urging means. For this reason, it is not necessary to move the cartridge supporting member in the contact or spacing between the cartridge and the positioning portion of the main assembly, and the operation of the opening and closing member does not require a large force. By this, in the case of the user's the exchange of the cartridge and the jam clearance operation, the operation for moving the cartridge supporting member is easy, and the operativity property of the maintenance is improved.

These and other objects, features, and advantages of the present invention will become more apparent upon consideration of the following description of the preferred embodiments of the present invention, taken in conjunction with the accompanying drawings.

PREFERRED EMBODIMENTS OF THE INVENTION

A preferable embodiment of the present invention will be described referring to the accompanying drawings. The dimensions, the materials, the configurations, the relative positions, and soon of the constituent parts which will be described hereinafter may be properly changed by one skilled in the art depending on the structures and the various conditions of a device to which this invention is applied, and the scope of this invention is not limited to specific dimensions, materials, configurations, relative positions and so on of the embodiments which will be described below.

<First Embodiment>

<General Arrangement of Color Electrophotographic Image Forming Apparatus>

Figure 1A:
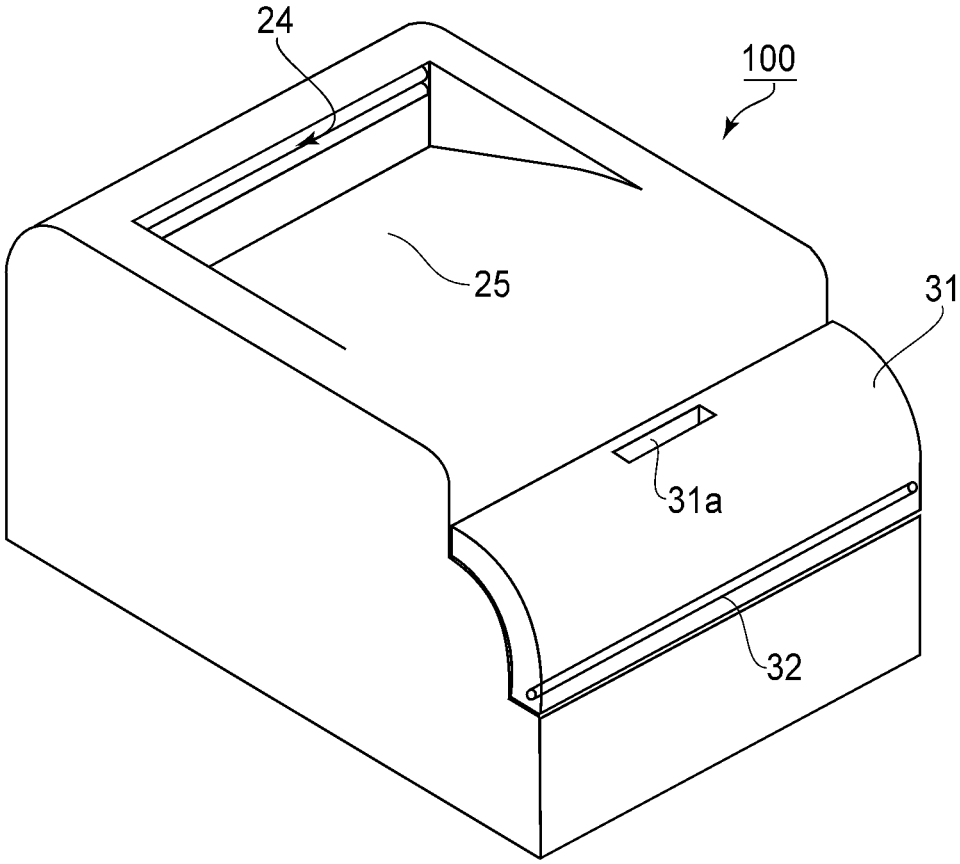
FIG. 1A is an outer appearance perspective view of the image forming apparatus of Embodiment 1.
Figure 1B:
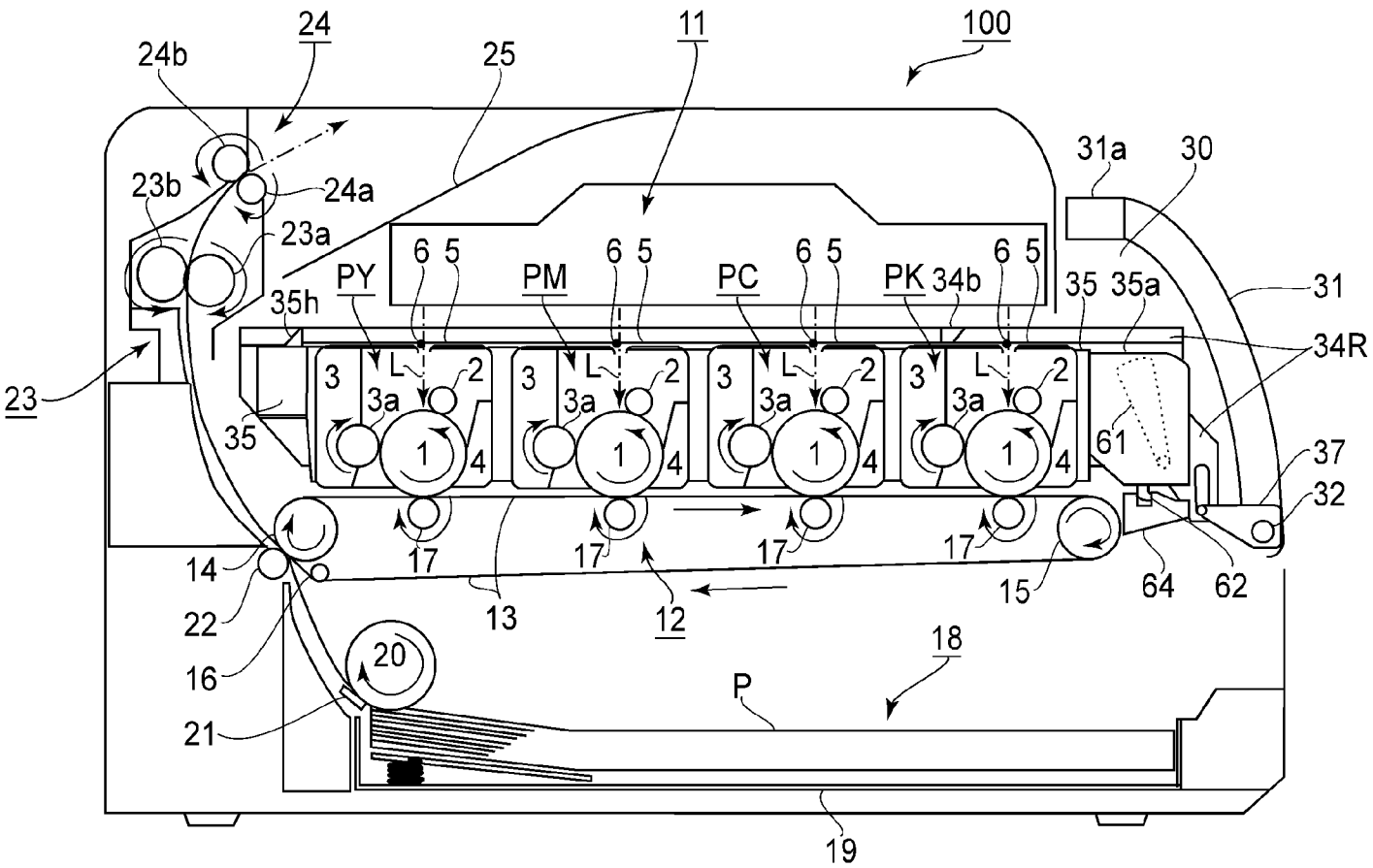
FIG. 1B is a sectional view of an image forming apparatus.
Figure 5:
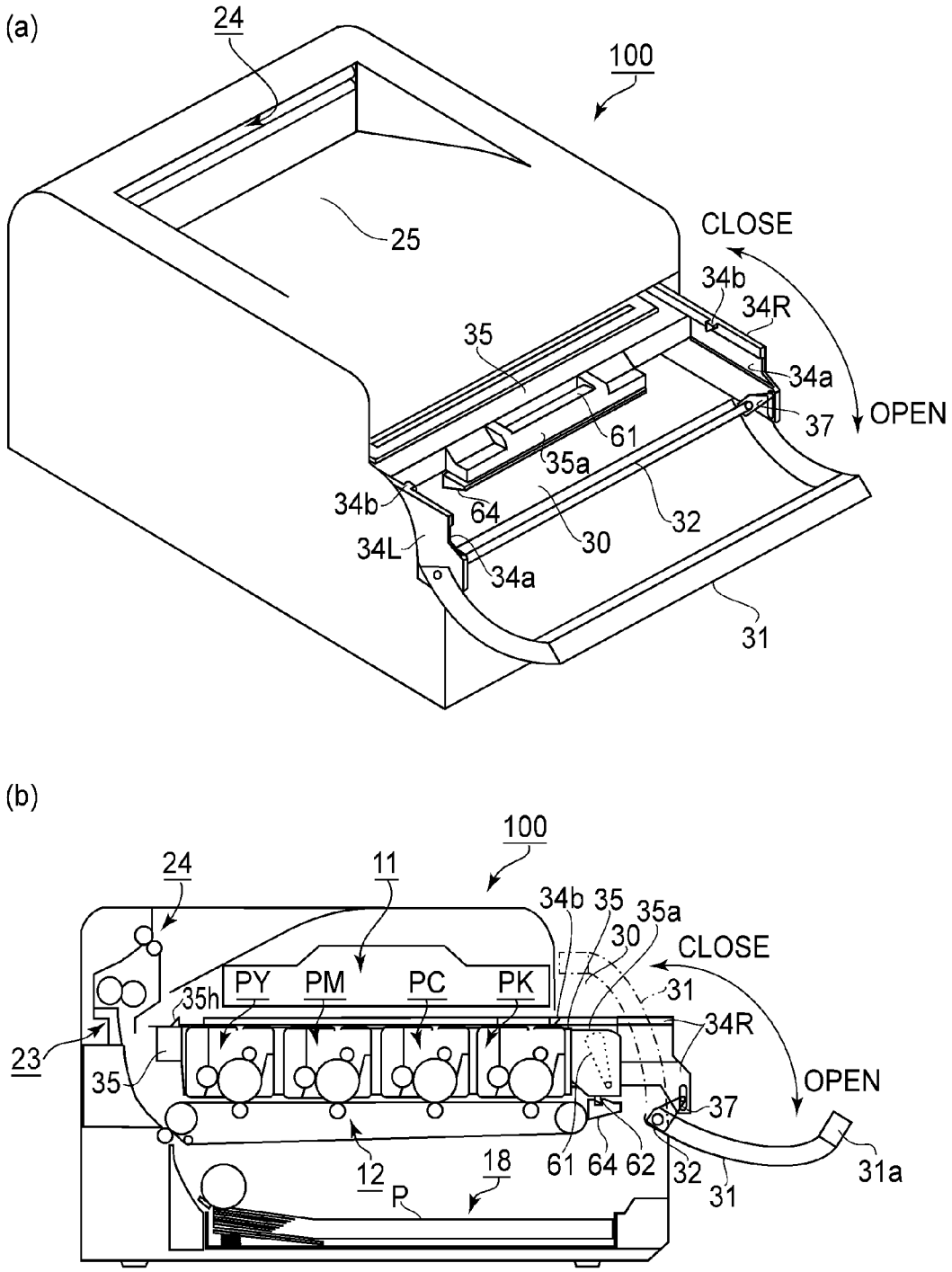
In FIG. 5, (a) is an outer appearance perspective view of the image forming apparatus in the state of opening a door, and (b) is a sectional view of an image forming apparatus.
Figure 6A:
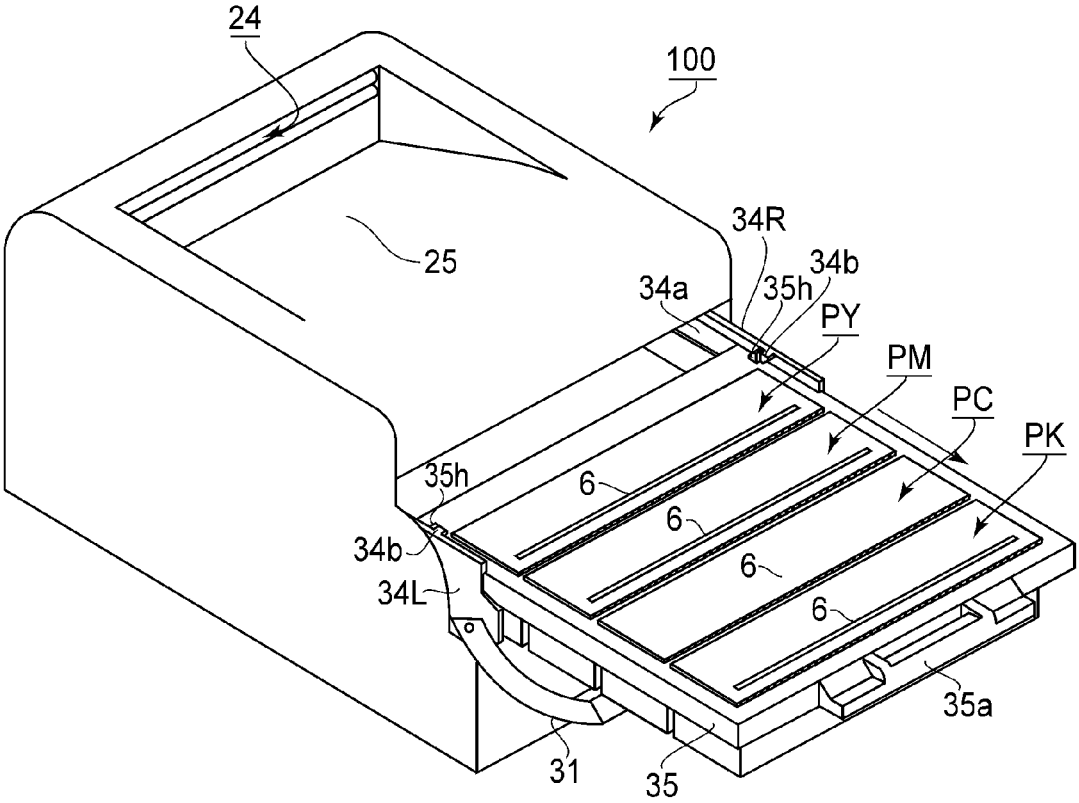
FIG. 6A is an outer appearance perspective view of the image forming apparatus in the state that the tray is drawn.
Figure 6B:
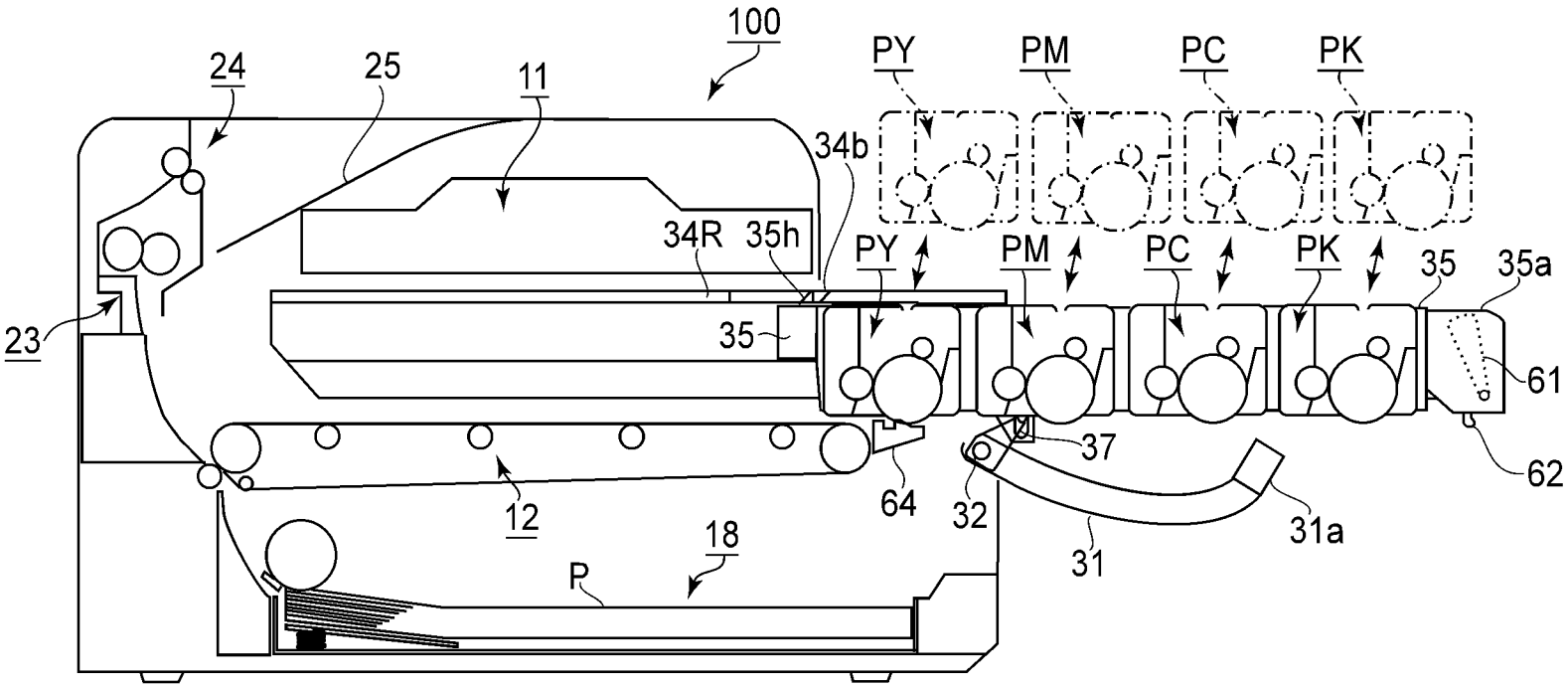
FIG. 6B is a sectional view of an image forming apparatus.

Referring first to FIGS. 1, 5, and 6, the general arrangement of the color electrophotographic image forming apparatus (image forming apparatus) according to the first embodiment will be described. FIG. 1A is an outer appearance perspective view of the image forming apparatus of Embodiment 1, and it is a sectional view of the image forming apparatus shown in FIG. 1B. FIGS. 5 and 6 are illustrations showing the exchange of a process cartridge (cartridge). Part (a) of FIG. 5 is an outer appearance perspective view of the image forming apparatus of the state that the door is opened, and <b> Of FIG. 5 is a left side longitudinal sectional view of the image forming apparatus 100. FIG. 6A is an outer appearance perspective view of the image forming apparatus in the state that the tray is drawn, and FIG. 6B is a sectional view of an image forming apparatus.

The image forming apparatus is a laser printer of a full-color (four colors) type which uses an electrophotographic process. The image forming apparatus forms a full-color image on a recording material (sheet) S on the basis of the electrical image signal inputted to a control circuit portion from an external host device (unshown) such as a personal computer, an image reader, a receiving part of a facsimile device.

In the following descriptions, the image forming apparatus main assembly 100 is the portions of the image forming apparatus other than the cartridges PY, PM, PC, PK as will be described hereinafter. In the main assembly 100 of the image forming apparatus, a front side is a side which is provided with a door (opening and closing member) 31. A backside is the opposite side from it. The front-rear directions are a direction to the front side from the backside of the main assembly 100 of the image forming apparatus and the reverse direction thereof. The left and the right are the left and the right, as seen from the front side of the image forming apparatus. The left-right directions are a direction to the left from the right, and the reverse direction thereof.

As shown in FIG. 1, in image forming apparatus main assembly 100 (main assembly) a first-fourth horizontal process cartridges P (PY, PM, PC, PK) are juxtaposed from the backside to the front side. The process cartridges (cartridges) P have the structures which are similar to each other except for the colors of the accommodated powdery developer. Each cartridge includes an electrophotographic photosensitive drum 1, and the charging means 2, developing means 3, and cleaning means 4 as the process means which functions on the drum 1 integrally in the cartridge frame 5. The charging means 2 is a contact type charging roller. The developing means 3 is provided with a developing roller 3*a*, and a developer container contains a powdery developer (toner). The cleaning means 4 is a blade type means for example.

A first cartridge PY accommodates a yellow (Y) developer in the developing device 3 thereof, and forms a Y color developer image on the surface of the drum. A second cartridge PM accommodates a magenta (M) developer in the developing device 3 thereof, and forms an M color developer image on the surface of the drum. A third cartridge PC accommodates a cyan (C) developer in the developing device 3 thereof, and forms a C color developer image on the surface of the drum. A fourth cartridge PK accommodates a black (K) developer in the developing device 3 thereof, and forms a K color developer image on the surface of the drum.

In this embodiment, although the cartridge is an integral type process cartridge, the present invention is not limited to this. The cartridge P may have the structure described above.

An upper portion of the cartridge P mounted to the main assembly 100*a* is provided with a laser scanner unit 11. A unit 11 outputs a laser beam L modulated correspondingly to the image information of each color inputted from the external host device. The laser beam L passes an exposure window 6 provided in an upper surface of a cartridge frame 5, and scanningly exposes the drum surfaces of the cartridges. By this, an electrostatic latent image is sequentially formed on the drum 1. Subsequently, the electrostatic latent image is developed by the developing means 3 to form a developer image on the drum 1.

An upper portion of the cartridge P mounted to the main assembly 100 is provided with an intermediary transfer belt unit 11. A belt unit 12 is made from a dielectric material, and an intermediary transfer member (belt member) is provided with an endless belt 13 having flexibility, a driving roller 14 for extending and stretching and circulating the belt 13 in the direction indicated by an arrow of FIG. 1, a tension roller 15, and a turning roller 16. The driving roller 14 and the turning roller 16 are provided in the backside of the main assembly. The tension roller 15 is provided in the front side of the main assembly. As for a photosensitive drum 1 of each cartridge, a lower surface thereof contacts to the upper surface of a belt 13 (this position of each cartridge is an image forming position). Inside the belt 13, the four primary transfer rollers 17 opposed to the photosensitive drums 1 of cartridges P is provided. To the driving roller 14, a secondary transfer roller 22 is urged through the belt 13.

A lower part of the belt unit 12 includes a feeding unit 18. The feeding unit 18 includes a feeding cassette 19 for stacking recording material, a feeding roller 20, a separation pad 21, and so on. The feeding tray 19 can be pulled out and pushed in at front side of a main assembly.

A backside upper portion in the main assembly 100 is provided with a fixing device 23 and a pair of discharging rollers 24. The upper surface of the main assembly 100 is provided with a discharging tray 25. The fixing device 23 includes a fixing film 23*a* and a pressing roller 23*b*. The discharging roller pair 24 includes a discharging roller 24*a* and a discharging roller 24*b*.

The each cartridge mounted to a latent image forming position in the main assembly 100 is pressed by positioning urge means as will be described hereinafter to be placed in a predetermined position in the main assembly 100. The drive outputting portions of the main assembly side is coupled to the drive inputting portions of each of the cartridge. The electrical contacts of the cartridge are electrically connected to the electric power supply system in the main assembly (100A) side.

The operation for forming a full-color image will be described. The drum 1 of each of the first-fourth cartridge P is rotationally driven in the direction indicated by the arrow (counterclockwise direction in FIG. 1) at the predetermined speed. The belt 13 is rotationally driven at the speed corresponding to the speed of the drum 1 in the clockwise direction (codirectional with the rotation of the drum) of the arrow. The scanner unit 11 also is driven. In synchronism with this drive, a predetermined charging bias voltage is applied to the charging roller 32*b* at the predetermined controlled timing in each cartridge P to charge the surface of the drum in a predetermined polarity. A scanner unit 11 exposes the surface of each drum scanningly to the laser beam L modulated in accordance with each color image signal. By this, the electrostatic latent images corresponding to the associated color image signals are formed on the surfaces of the drum 1. The electrostatic latent image formed is developed by the developing means 3.

Through the above-described electrophotographic image forming process operation, a Y color developer image corresponding to a yellow component of the full-color image is formed on the drum 1 of the cartridge PY. The Y color toner image is transferred (primary transfer) onto the belt 13.

An M color toner image corresponding to a magenta component of the full-color image is formed on the drum 1 of the cartridge PM. The M color toner image is transferred superimposingly onto the color toner image already transferred onto the belt 13Y.

On the drum 1 of the cartridge PC, a C color toner image corresponding to a C color component of the full-color image is formed. The C color toner image is transferred superimposingly onto the color+M color toner image already transferred onto the belt 13Y.

A K color toner image corresponding to a black component of the full-color image is formed on the drum 1 of the cartridge PK. The K color toner image is transferred superimposingly onto the color+M color+C color toner image already transferred onto the belt 13Y.

In this way, a full-color toner image of the Y color+M color+C color+K color is synthetically formed on the transfer member 13.

The untransferred developer remaining on the drum surface after the primary transfer of the toner image relative to the transfer belt 13 is removed by the cleaning blade 4 in each cartridge.

On the other hand, the feeding roller 20 is driven at the predetermined controlled timing. Then, by the cooperation between the feeding roller 20 and the separation pad 21, the separation and feeding of the recording materials S stacked on the feeding tray 19 is carried out one by one to be introduced into a nip (secondary transfer nip) between the secondary transfer roller 22 and the belt 13. By this, while the recording material S is nipped and fed by the transfer nip, the four color toner image superimposed on the belt 13 is sequentially transferred (secondary transfer) onto the surface of recording material S.

The recording material S separated from the surface of the transfer belt 12 and is introduced into the fixing device 23, where it is heated and pressed through a fixing nip. By this, the color toner images are mixed and fixed on recording material S. The recording material S is discharged out of the fixing device 23, and is discharged onto the tray 25 by discharging roller pair 24 as a full-color print.

The residual toner remaining on the surface of the transfer member after the separation of the recording material 34 is electrostatically deposited onto the surface of the drum 1 in the primary transfer nip of the cartridge PY, for example. The residual toner is removed by the cleaning means 4.

For the usability improvement, the tray 35 is drawn out of the main assembly 100 in the state that the cartridges P (PY, PM, PC, PK) are supported on the cartridge tray 35 (cartridge supporting member). In this manner, a user can exchange the cartridge in the front side (side which has door 31) of the main assembly 100 (so-called front access). The tray 35 is supported by the tray holding member (rail member) 34 relative to the apparatus main assembly 100. The user grips a grip 35*a* and can slide the tray 35 in the front-rear direction. The door 31 is rotatable about a shaft 32 relative to the main assembly 100. FIG. 5 shows the state where the door 31 is opened.

The tray (cartridge supporting member) 35 is moved between the inside position I which is inside of the apparatus main assembly 100, and the outside position O which is outside of the apparatus main assembly 100, while supporting the cartridges PY, PM, PC and PK.

In the outside position O, the user mounts and demounts the cartridges P relative to the tray 35.

This will be described in detail, but it is pointed out here that the cartridge P mounted to and supported by the tray 35 in the outside position O is moved to the inside position I by the user pushing the tray 35 into the main assembly 100. The cartridge P is in the image forming position for contributing to an image formation (FIG. 1). Here, in the image forming position, a part of a photosensitive drum 1 contacts to a transfer belt 13. When the door 31 is closed in the state that the tray 35 is placed in the inside position I, each cartridge P is positioned in the predetermined position of a main assembly by the positioning urge means to be placed in the image forming position. When the door 31 is opened, each cartridge P is released from the positioning urge means, and is raised by an urging force of spacing and urging means to be spaced from the positioning portion of the main assembly. In this manner, the photosensitive drum 1 separates from the transfer belt 13. In this state, the user draws the tray 35 toward the outside position O of the main assembly 100. The positioning urge means and the spacing and urging means will be described hereinafter.

<Structure of Cartridge Tray>

Figure 2:
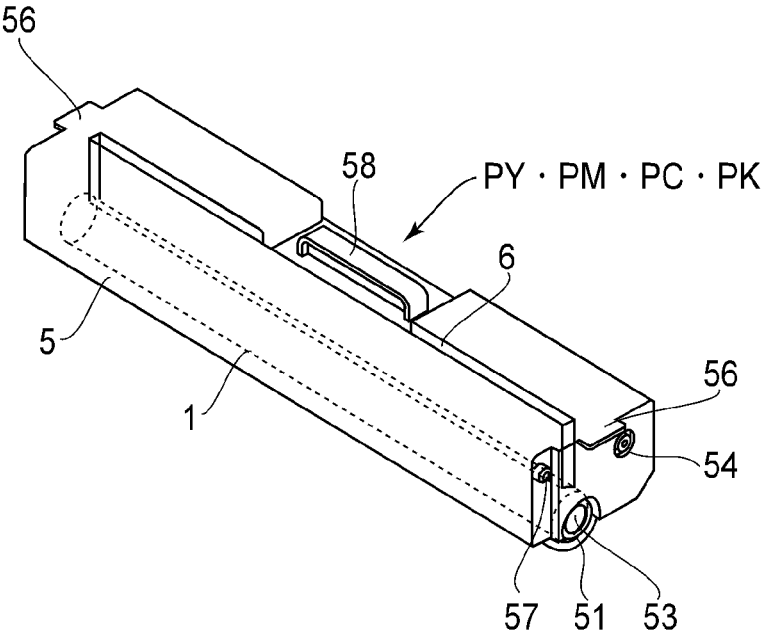
In FIG. 2, (a) is an outer appearance perspective view of a cartridge according to the first embodiment of the present invention, as seen from a driving side, and (b) is an outer appearance perspective view of the cartridge, as seen from a non-driving side.
Figure 2:
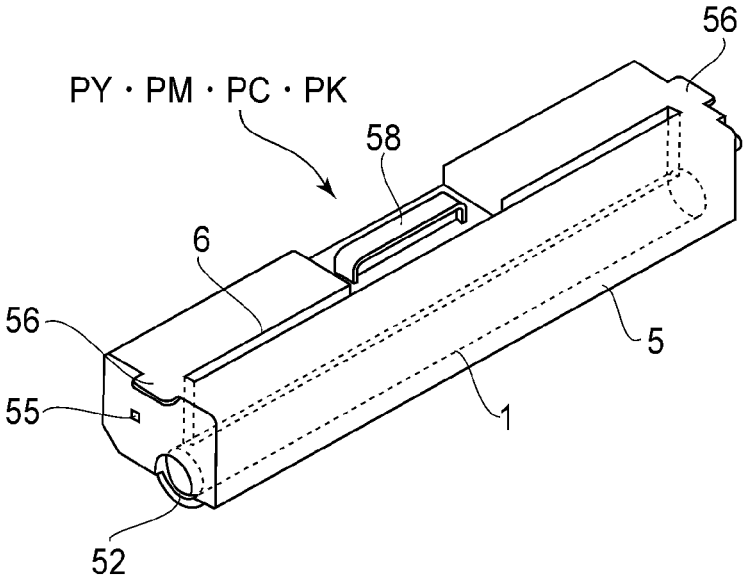

The (a) of FIG. 2, and (b) of FIG. 2 are outer appearance perspective views of the cartridge. Part (a) of FIG. 2 is a perspective view of the cartridge, as seen from the driving side, and (b) of FIG. 2 is a perspective view of the cartridge, as seen from the non-driving side.

In the cartridge, an axis of the drum 1 is extended in the left-right direction, and this left-right direction is the longitudinal direction of the cartridge (assembly of elongated box shape). The drum 1 is supported rotatably between the bearing portions 51, 52 provided at a right side portion and a left side portion of the cartridge frame 5. The right bearing 51 is provided with a coupling engaging portion 53 as a drum drive inputting portion. The right side surface portion is provided with a coupling engaging portion 54 as a development drive input portion for driving the developing roller 3*a*. The left side surface portion is provided with a cartridge electrical contact 55. The left side surface portion and the right side surface portion are provided with the visors 56 provided by overhangingly extending the top plate portion of the cartridge frame 5 to the left-right direction. A grip 58 to be griped when exchanging the cartridge is provided in the central portion of the top surface. Furthermore, the right side surface portion is provided with a projection 57 which regulates an orientation of cartridge P to prevent the inclination in the front-rear direction in the state that cartridge P is inserted into the tray 35. In cartridge P, the right side surface portion provided with the coupling engaging portions 53, 54 is the driving side, and the left side surface portion of the opposite side is the non-driving side.

Figure 3:
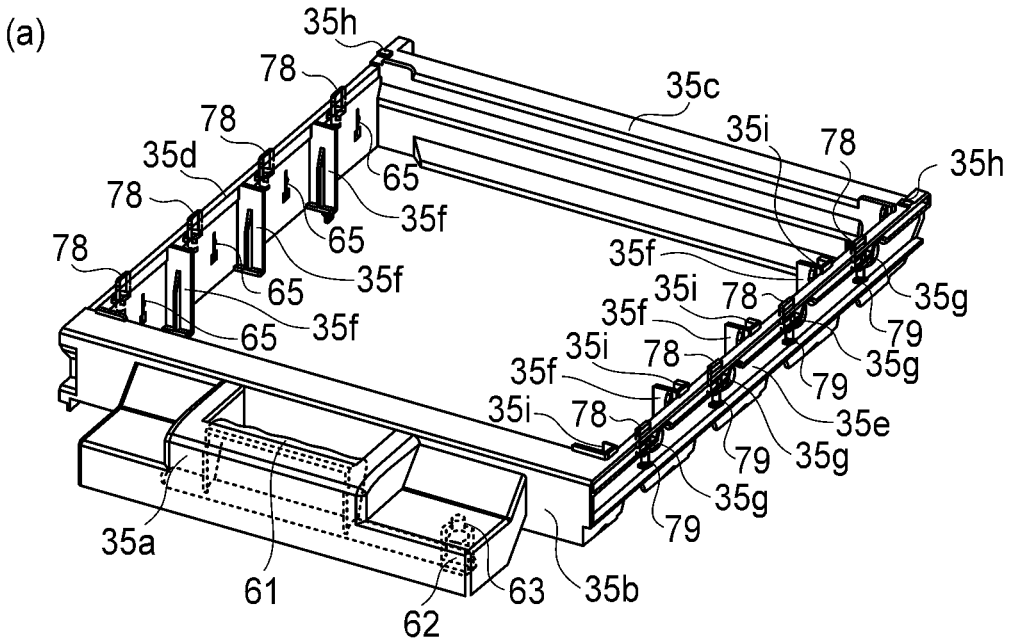
In FIG. 3, (a) is an outer appearance perspective view of a tray according to the first embodiment, as seen from the driving side, and (b) is an outer appearance perspective view of the tray, as seen from the non-driving side.
Figure 3:
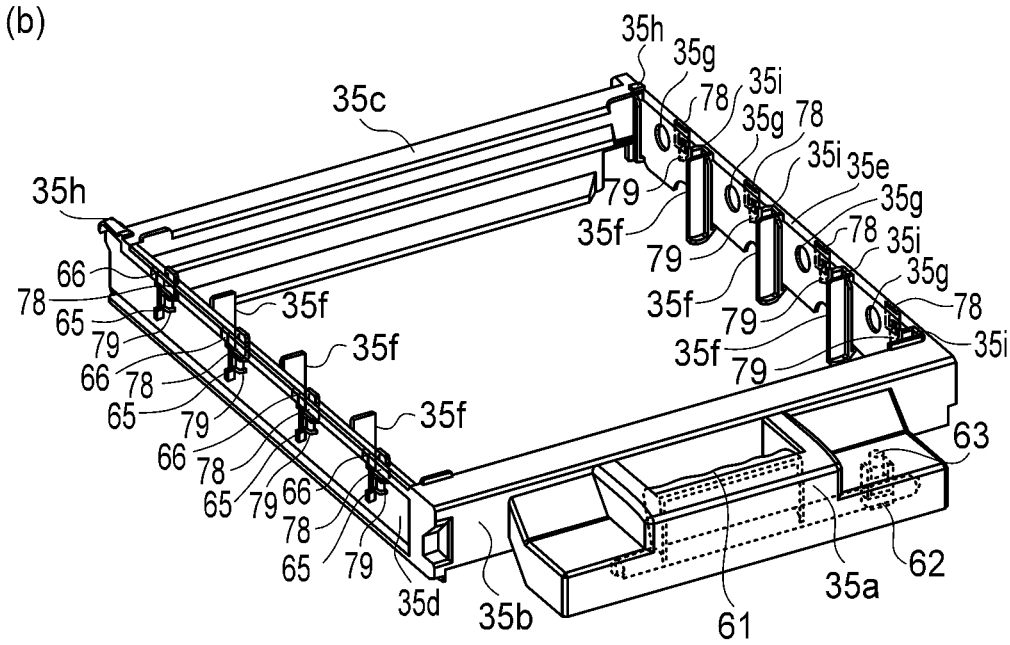

Part (a) of FIG. 3 is an outer appearance perspective view of the tray 35. Part (a) of FIG. 3 is a perspective view of the tray, as seen from the driving side, and (b) of FIG. 3 is a perspective view of the tray, as seen from the non-driving side.

The tray 35 is constituted, by the connection of the four frame parts 35*b*, 35*c*, 35*d*, 35*e* at front and rear, right and left portions, into a rectangular large frame. The inside of the large frame is divided into four chambers by partition plates 35*f* substantially equally in the front-rear direction. The first-fourth cartridges PY, PM, PC, PK are supported in the four divided chambers. A right frame part 35*e* is provided with the holes 35*g* which permit the passage of the development drive couplings corresponding to the first-fourth cartridges P, respectively.

The tray 35 is provided with an intermediate contact spring 65 electrically connected with an electrical contact 55 of cartridge P. A spring 65 is electrically connected with a main assembly side electrical contact pin 93 (FIG. 14) provided in the main assembly through an intermediate contact plate 66. This will be described hereinafter.

Furthermore, the left frame part 35*d* and the right frame part 35*e* of the tray 35 are provided with the contact members 78 which contact with the visors 56 of the four cartridge s and are and which supported upward. Each cartridge P is inserted from top into the corresponding chamber of the tray 35, and the lower surfaces of the left and right visors 56 contact to the top surfaces of the contact members 78. Thus, each cartridge P is supported by the tray 35.

Figure 4:
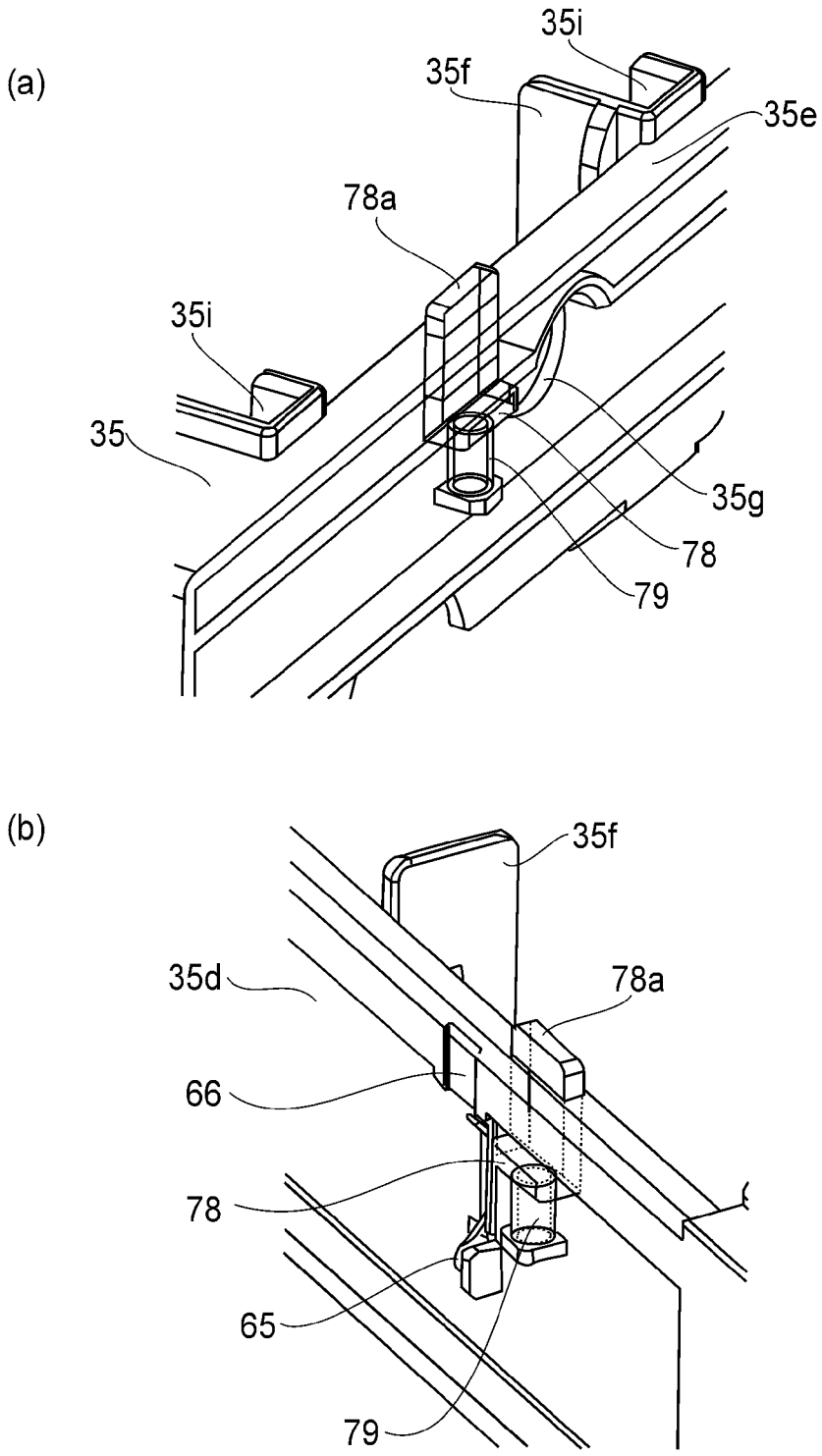
In FIG. 4, (a) is an enlarged view of the contact member portion provided in a right frame part of the tray, and (b) is an enlarged view of the contact member portion provided in a left frame part of the tray.

Part (a) of FIG. 4, and (b) of FIG. 4 are partial enlarged views of the contact members 78 provided on the right frame part 35*e* and the left frame part 35*d* of the tray 35, respectively. The contact members 78 are supported by the right frame part 35*e* and the left frame part 35*d*, and it is slidable in an up-down direction relative thereto. A lower portion of the contact member 78 is provided with a supporting spring 79 for urging the contact member 78 upwardly. A spring 79 urges the contact member 78 upwardly. The spring 79 supports the contact member 78 in the position in which the abutment surface 78*a* of the contact member 78 projects from the upper surface of the part 35*e*, 35*d*. The abutment surface 78*a* abuts downwardly to the left and right visors 56 of each cartridge P. By this, each cartridge P is supported.

The contact member 78 and the spring 79 constitute the spacing and urging means urged in the direction of spacing each cartridge P supported by the tray 35 from the belt 13.

The urging force of the spring 79 is set so as to be larger than the force applied to the visor 56 by the weight of each cartridge P. Therefore, in the state that the pressing of each cartridge is released by pressing means of the main assembly side which will be described hereinafter, each cartridge P is in the state where it is raised upwardly by the urging force of the spring 79.

The right frame part 35*e* of the tray 35 is provided with a groove 35*i* for regulating the orientation of the cartridge by engaging with the projection 57 of each cartridge P. The groove 35*i* regulates the movement of a projection 57 in the front-rear direction. In other words, each cartridge P is capable of being pulled out directly upwardly from the tray 35, and each cartridge P is supported by moving directly downwardly.

The left frame part 35*d* is in engagement with a guiding groove 34*a* which is extended in the front-rear direction inside the tray holding member 34L ((a) of FIG. 5). The right frame part 35*e* is in engagement with a guiding groove 34*a* ((a) of FIG. 5) extended in the front-rear direction in the tray holding member 34R. By this, the tray 35 is supported between the tray holding members 34L, 34R. The tray 35 can horizontally be slid to the front-rear direction relative to the tray holding members 34L, 34 R along the guiding groove 34*a*.

As shown in FIG. 3, the frame part 35*b* is provided with the grip 35*a* to be griped when drawing the tray 35 to a drawn-out position, in the state that the door 31 is opened. An inside of the grip 35*a* is provided with a locking member 62 for regulating the movement of the tray 35 in the front-rear direction and a lock releasing lever 61 for releasing a movement regulation by the locking member 62. The locking member 62 is urged downwardly by a lock spring 63. In the state that the tray 35 is in the main assembly, the locking member 62 engages with a lock receptor member 64 (FIG. 5) provided in the main assembly. In this manner, the movement of the tray 35 in the front-rear direction is regulated. The user grips the grip 35*a* and the lock releasing lever 61, and rotates the lock releasing lever 61, and then the locking member 62 moves upwardly against the urging force of the spring 63. An engagement between the locking member 62 and the lock receptor member 64 is released, so that the movement of the tray 35 of the front-rear direction is permitted.

<Cartridge Exchanging System>

For the usability improvement, the exchange of the cartridge P is carried out in the state that the cartridge P is carried on the tray 26 in the front access type.

In order to accomplish this, the front side of the main assembly is provided with an opening portion 30 (FIG. 5) for passing the cartridge P to insert the cartridge P into the main assembly 100 and to dismount the cartridge P from the main assembly 100.

In addition, the door (opening and closing member) 31 movable between a closed position for closing the opening portion 30 and an open position for opening the opening portion 30 are provided.

Here, the door 31 is rotatable for opening and closing relative to the main assembly 100 about a horizontal axis (hinge shaft) 32 of a lower side of the door. In other words, the door 31 is rotated about a hinge shaft 32 axis in the raising direction so that main assembly 100 can be closed (FIG. 1). By closing the door 31, the opening portion 30 is closed. The door 31 is tilted and rotated in the front side of the main assembly 100 about the hinge shaft 32 to open the main assembly 100 (FIG. 5). By this, the opening portion 30 is widely opened. Designated by 31*a* is a finger-engaging-portion for the opening and closing provided in the door 31.

Inside the main assembly 100, tray holding members (left and right rails) 34L and 34R2 extended in a front-rear direction is provided. The tray (cartridge supporting member) 35 is horizontally slidably held in the front-rear direction between the tray holding members 34L, 34R. Each cartridge P is supported on the tray 35.

The doors 31 and the tray holding members 34L, 34R are coupled by a door linking member 37 with each other. As shown in the FIGS. 1 and 5, the tray holding members 34L, 34R forwardly move through the predetermined amount in interrelation with the opening rotation of the door 31. By this, the front part of the tray holding members 34L, 34R is drawn to the position spaced through the predetermined amount outwardly of the main assembly 100 from the opening portion 30 (FIG. 5). At this time, the tray 35 is regulated in the horizontal movement by the locking member 62 and the lock receptor member 64. For this reason, even if the door 31 is opened, the tray holding members 34L, 34R do not move with the door 31, and it is maintained at the position shown in FIG. 1.

In interrelation with the movement of the tray holding members 34L, 34R, the connection between the drum drive coupling (drive outputting portion) 81 and development drive coupling (drive outputting portion) 82 (FIG. 7) relative to the drive inputting portion of each cartridge P is released (drive releasing). The couplings 81, 82 are provided in the main assembly 100.

By the opening operation of the door 31, each cartridge P is pressed downwardly, so that the pressing by the urging member 71 (FIG. 7, FIG. 8) and the contact member 75 (FIG. 7, FIG. 9) is released (pressing releasing). The urging member 71 and the contact member 75 constitute positioning urge means which urges each cartridge P in the direction of positioning to the positioning portion 91*a* of the main assembly 100 by the operation of closing the door 31 and which releases the urging of each cartridge P by the operation of opening the door 31.

When the pressing of the urging member 71 and the contact member 75 is released, the contact member 78 provided on the tray 35 is moved through the predetermined amount upwardly by the urging force of the spring to push up each cartridge. By this, the drum 1 of each cartridge P spaces from the belt 13 and a cartridge positioning portion 91*a* (FIG. 7, FIG. 12) of the inner plates 91L, 91R. Therefore, the tray 35 can be moved in the horizontal direction. In this manner, the drum 1 and the belt 13 do not rub with each other and therefore a belt flaw and drum memory can be prevented (cartridge spacing). The drive releasing, the pressing releasing, and cartridge spacing will be described hereinafter.

In the state after the drive releasing, the pressing releasing, and cartridge spacing, the user grips the grip 35*a* exposed through the opening portion 30, and operates the lock releasing lever 61. By this, a lock of the tray 35 relative to the main assembly 100 is released. In the state that the lock is released, the user grips the grip 35*a* of the tray 35, and forwardly slides the tray 35 horizontally relative to the tray holding members 34L, 34R. The user sufficiently draws the tray 35 through the opening portion 30 to the predetermined drawn-out position in the outside of the main assembly 100 (FIG. 6).

By this, the entirety of the first-fourth cartridges PY, PM, PC, PK held by the tray 35 s are exposed in the outside of the main assembly 100 through the opening portion 30. In other words, the upper surfaces of all the cartridge s P are opened. The tray 35 is provided with an abutting portion 35*h* for regulating the movement of the tray 35 in the drawing direction. When the tray 35 is sufficiently drawn out, the abutting portion 35*h* and a locking portion 34*b* provided on the tray holding member 34 are contacted to each other. By this, the further drawer movement of the tray 35 is prevented. The tray 35 is kept stable by the tray holding members 34L, 34R in the state of horizontally drawing to the predetermined drawn-out position. In view of this, from the tray 35, the user raises the used cartridge which should be exchanged upwardly and pulls it out (FIG. 6B). A new cartridge is inserted from top into the tray 35.

The user draws the tray 35 to the drawn-out position, and the cartridge which should be exchanged among the cartridges held by the tray 35 is exchanged. Thereafter, the user pushes the tray 35 in sufficiently inversely, and accommodates it in the inside of the main assembly 100 (FIG. 5). In pushing the tray 35 into the inside of a main assembly 100, the inclined surface provided on the lock receptor member 64 pushes up the inclined surface provided on the locking member 62. For this reason, the locking member 62 is automatically moved upwardly by pushing the tray 35 in without the operation of the lock releasing lever 61. If the tray 35 is sufficiently pushed in, and the state is as shown in FIG. 5, the locking member 62 is moved downwardly to engage with the lock receptor member 64.

The user closes the door 31 (FIG. 1). In interrelation with the closing rotation of the door 31, the tray holding members 34L, 34R moves by the predetermined amount rearwardly. In this manner, each cartridge P is pressed by the urging member 71 and the contact member 75. Each cartridge P is held in the state fixed to the positioning portion 91*a* provided on the plates 91L, 91R. By each cartridge P being positioned and fixed to the positioning portion 91*a*, the drum 1 of each cartridge P contacts to the belt 13. The drive outputting portions of the main assembly (100A) side is coupled to the drive inputting portions of each of the photosensitive units 32 and each of the developing cartridge cartridges 33. Furthermore, the electric power supply system of the apparatus main assembly is electrically connected to the electrical contact of each cartridge.

<Interface Part Around Cartridge, and Cartridge Positioning Method>

Referring to FIGS. 7-13, an exchanging system for the cartridge will be described. FIGS. 7-13 illustrate a releasing method for the interface part around the cartridge in interrelation with the tray holding members 34L, 34R and the positioning method for the cartridge, the positioning and releasing method for the cartridge relative to a main assembly. The mechanism of the exchanging system of the cartridge will be described, wherein the drive, the pressing, electric power supply is released in interrelation with the tray holding members 34L, 34R, and the cartridge is spaced from the belt and the main assembly positioning portion.

Figure 7A:
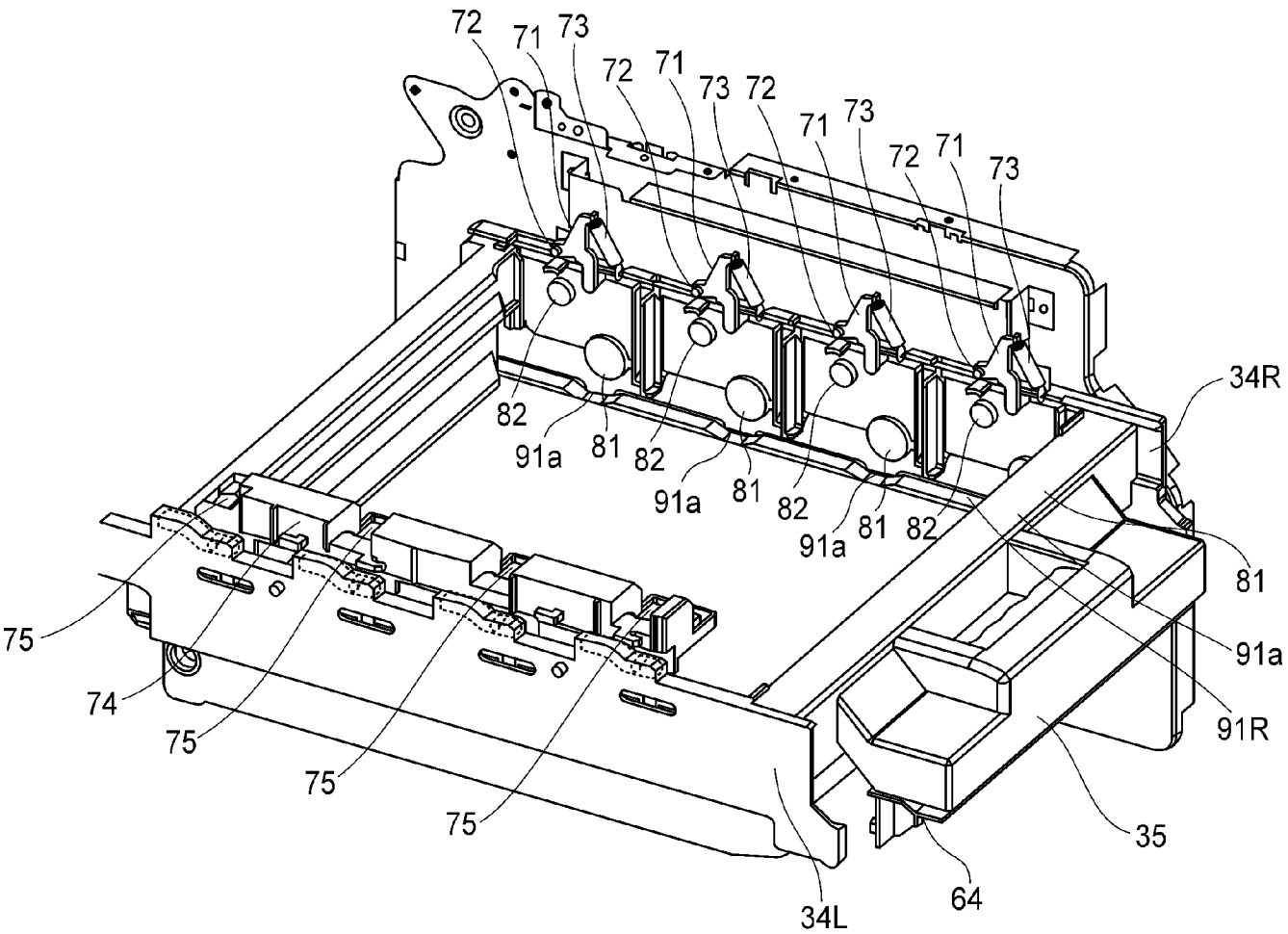
FIG. 7A is a perspective view illustrating the state that the cartridge is not placed but the door is shut.

FIG. 7A shows the state that the door 31 is shut in the state that cartridge P is not mounted.

A right-hand side of the main assembly 100 is provided with the couplings 81, 82 coupled with the drive inputting portion of each cartridge P. The coupling 81 rotationally drives the photosensitive drum 1 of each cartridge P. The coupling 82 rotationally drives the developing roller 3*a* of each cartridge P.

The main assembly 100 is provided with an urging member 71 which presses a right-hand end portion top surface of each cartridge P in order that the cartridge is fixed to the main assembly 100.

Figure 8:
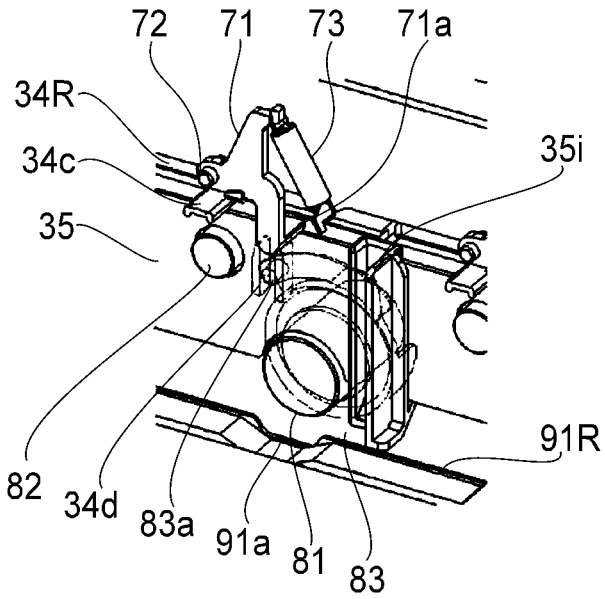
In FIG. 8 (a) is an enlarged view of an urging member, a drum drive coupling, a development drive coupling shown in FIG. 7A, and (b) is an enlarged view of the urging member, the drum drive coupling, the development drive coupling shown in FIG. 7B.
Figure 8:
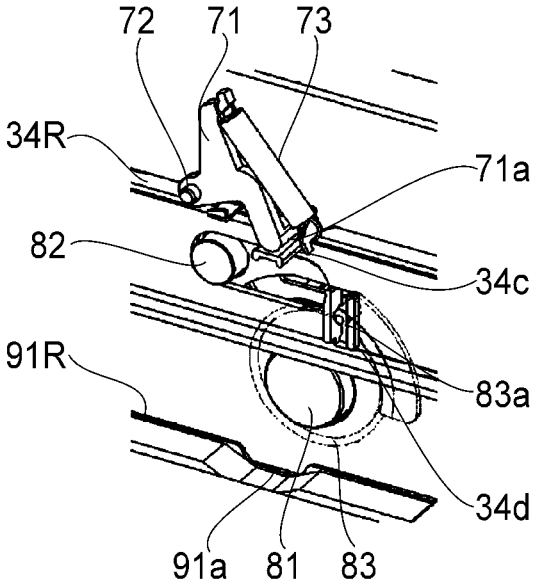

Part (a) of FIG. 8 is a partly enlarged view of the urging member 71 and the couplings 81, 82 shown in FIG. 7A. The urging member 71 is provided rotatably about a fulcrum 72 in the main assembly 100, and is urged, so that a spring force of a spring 73 presses cartridge P downwardly through a lever part 71*a*.

A left-hand side of the main assembly 100 is provided with an input contact portion of each cartridge P and a contact member 75 to couple in order to supply the electric power to each cartridge P.

Figure 9:
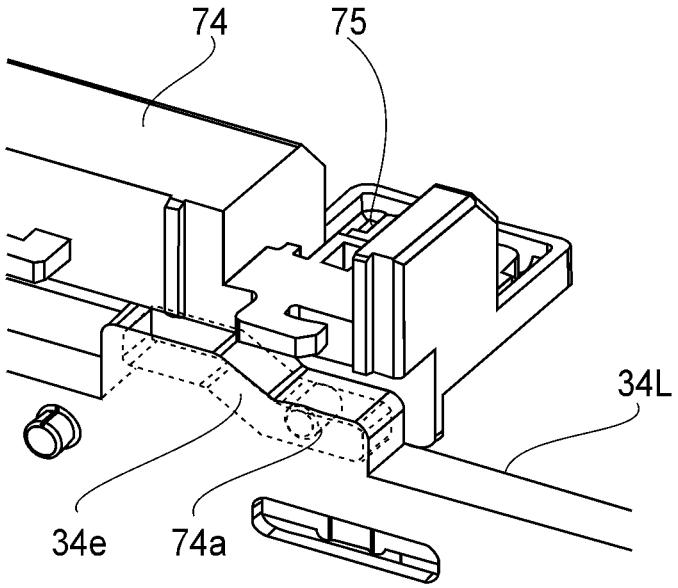
In FIG. 9, (a) is an enlarged view of a contact member portion shown in FIG. 7A., the part (b) of FIG. 9 is an enlarged view of the contact member portion of FIG. 7B.
Figure 9:
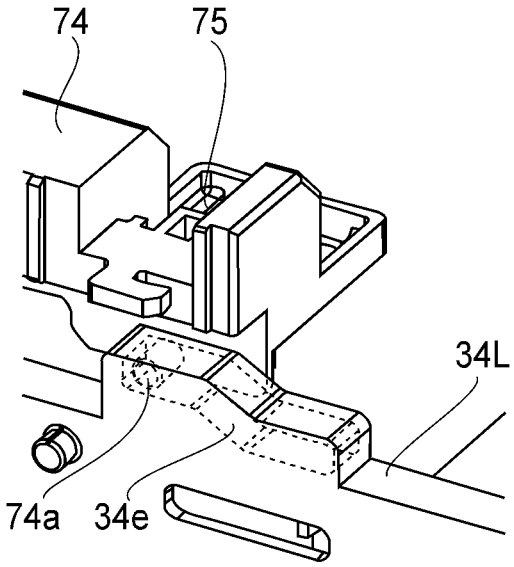

Part (a) of FIG. 9 is a partly enlarged view of the contact member 75 shown in FIG. 7A. The contact member 75 is supported movably in the up-down direction by a contact holding member 74. A holding member 74 is provided movably in up and down direction on the main assembly 100. The contact member 75 is urged downwardly by a contact member urging spring 76 ((b) of FIG. 12, and (b) of FIG. 13)

provided on the contact member 75. In the state that the holding member 74 takes the lower position as shown in (a) of FIG. 9, the contact member 75 is pressed to cartridge P by the urging force of a spring 76. Cartridge P is fixed to the positioning portion 91*a* of the inner plate 91L by this pressing. In other words, the contact member 75 and the urging member 71 described above constitute the positioning urge means for positioning and fixing cartridge P in the positioning portion of the main assembly 100. The contact member 75 functions also as the electric power supply means for supplying the electric power to cartridge P.

Figure 10A:
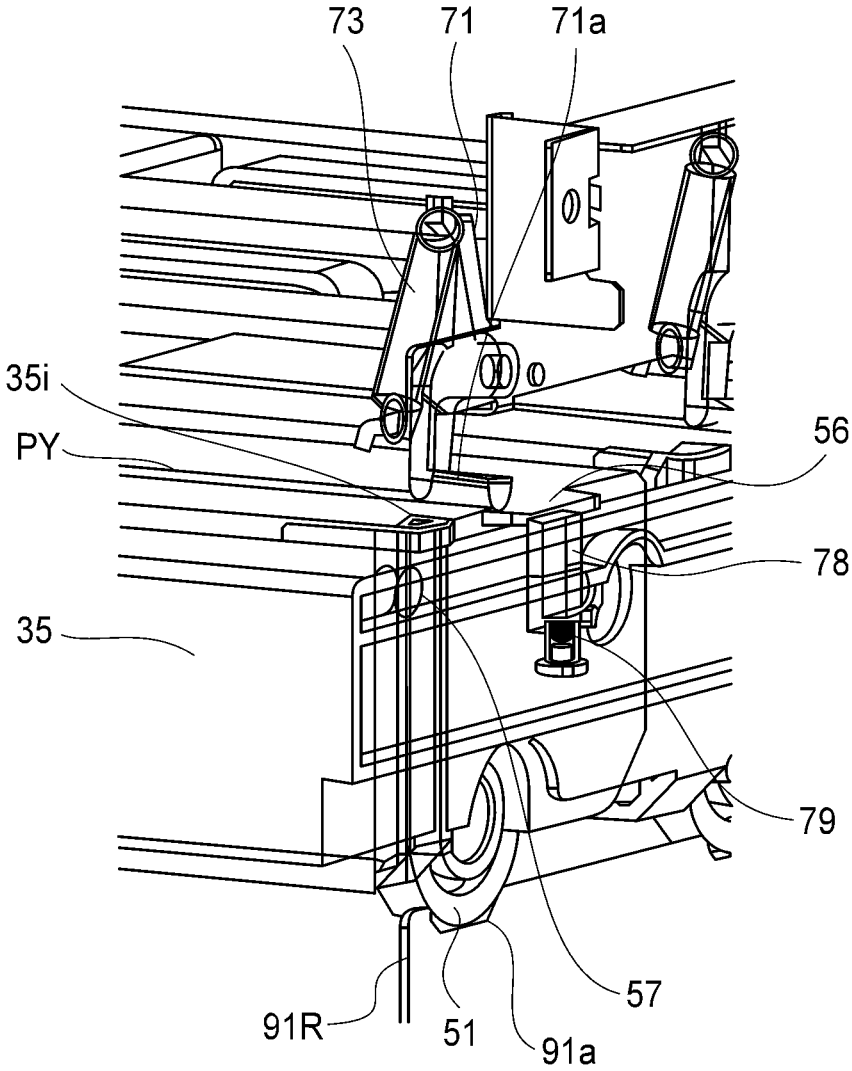
FIG. 10A is a perspective view of the cartridge, the tray, an urging member portion in the state where the tray in which the cartridge is inserted is pushed into the main assembly and the door is closed.
Figure 11:
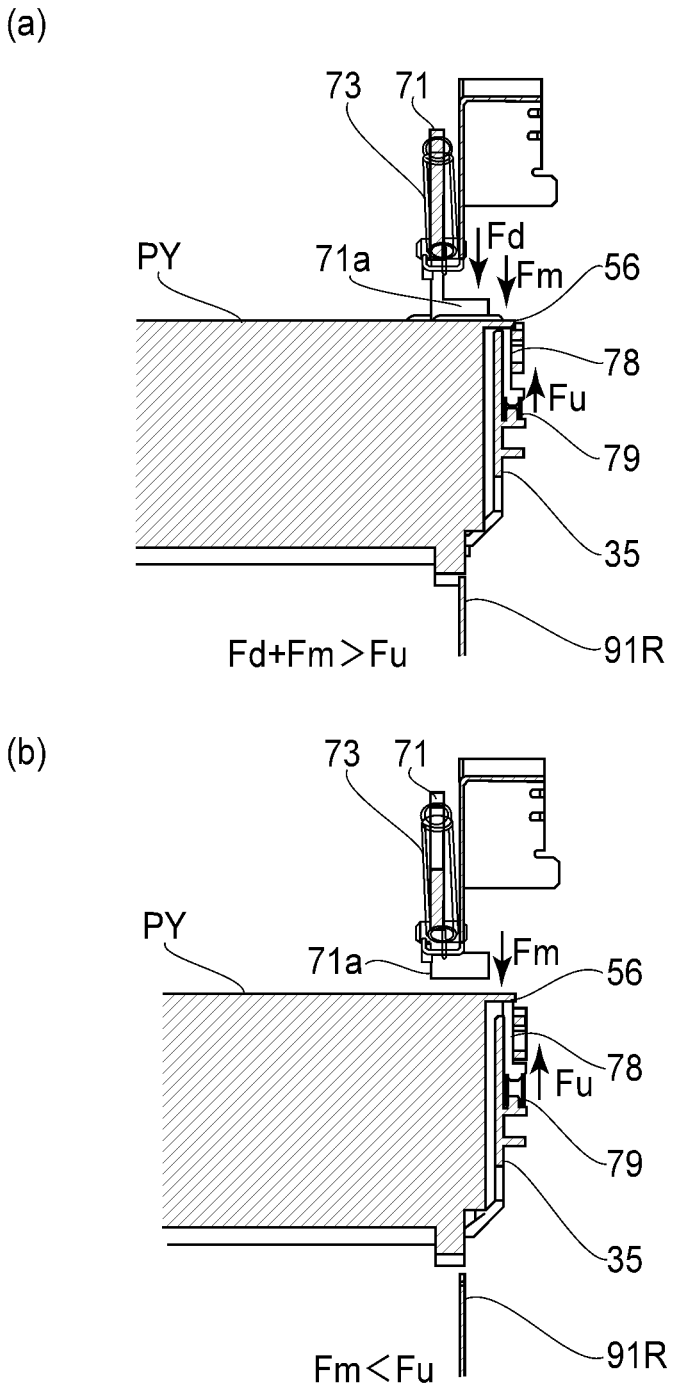
In FIG. 11, (a) is a sectional view, as seen from a front side of the main assembly in the state of FIG. 10A, and (b) is a sectional view, as seen from the front side of the main assembly in the state of FIG. 10B.

FIG. 10A is a fragmentary perspective view of the cartridge PY, the tray 35, and an urging member 71, in the state that the tray 35 supporting cartridge P is pushed in the main assembly, and the door 31 is closed (FIG. 1). Part (a) of FIG. 11 is a sectional view of the state thereof, as seen from the front side of the main assembly. Here, the description will be made as to the cartridge PY, but the same applies to the other cartridges PM, PC and PK.

In the state shown in (a) of FIG. 10A and FIG. 11, the urging member 71 contacts with the cartridge PY to press the cartridge PY downwardly. The urging member 71 is urged downwardly by the spring 73. An urging force which depresses the cartridge PY by the urging member 71 is Fd. The contact member 78 urges the cartridge PY upwardly. The contact member 78 is urged upwardly by the spring 79 provided in the tray 35. An urging force which urges the cartridge PY upwardly by the contact member 78 is Fu. A urging force which urges the cartridge PY upwardly Fu from the contact member 78 is set so as to be smaller than the resultant force of an urging force Fd which depresses the cartridge from the urging member 71 and a force Fm applied to the contact member 78 by the weight of the cartridge (Fd+Fm>Fu). For this reason, the right bearing 51 of the cartridge PY is pressed to the positioning portion 91*a* of the inner plate 91R to position the center of the drum 1. The projection 57 of the cartridge PY is engaged with the groove 35*i* provided in the tray 35 to regulate the inclination, with respect to front-rear direction, of the cartridge PY.

Figure 12:
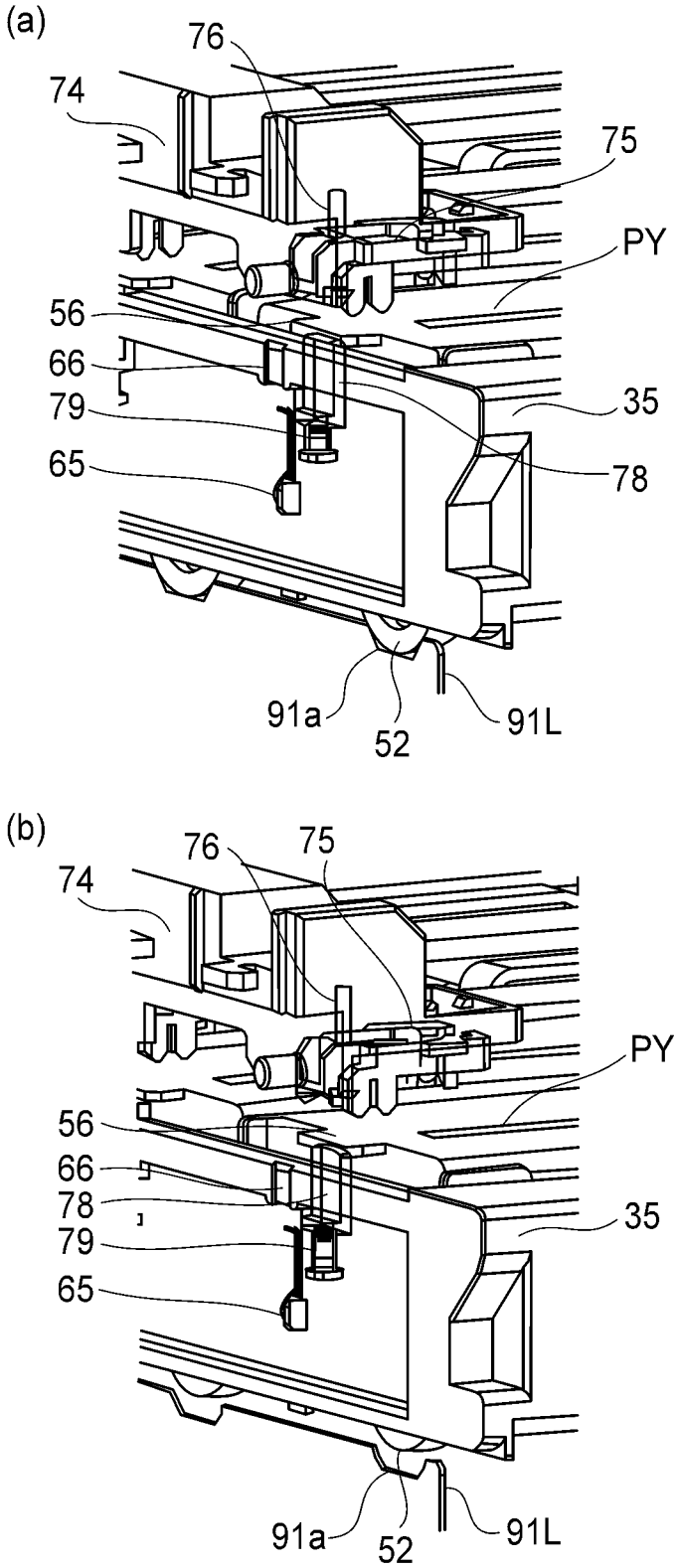
In FIG. 12, (a) is a perspective view of the cartridge, the tray, and the contact member portion in the state which is the same as FIG. 10A, and (b) is a perspective view of the cartridge, the tray, the urging member in the state same as FIG. 10B.

Part (a) of FIG. 12 is a fragmentary perspective view of the cartridge PY, the tray 35, and the contact member 75 in the state of FIG. 10A. Part (a) of FIG. 13 is a sectional view, as seen from the front side of the main assembly.

Figure 13:
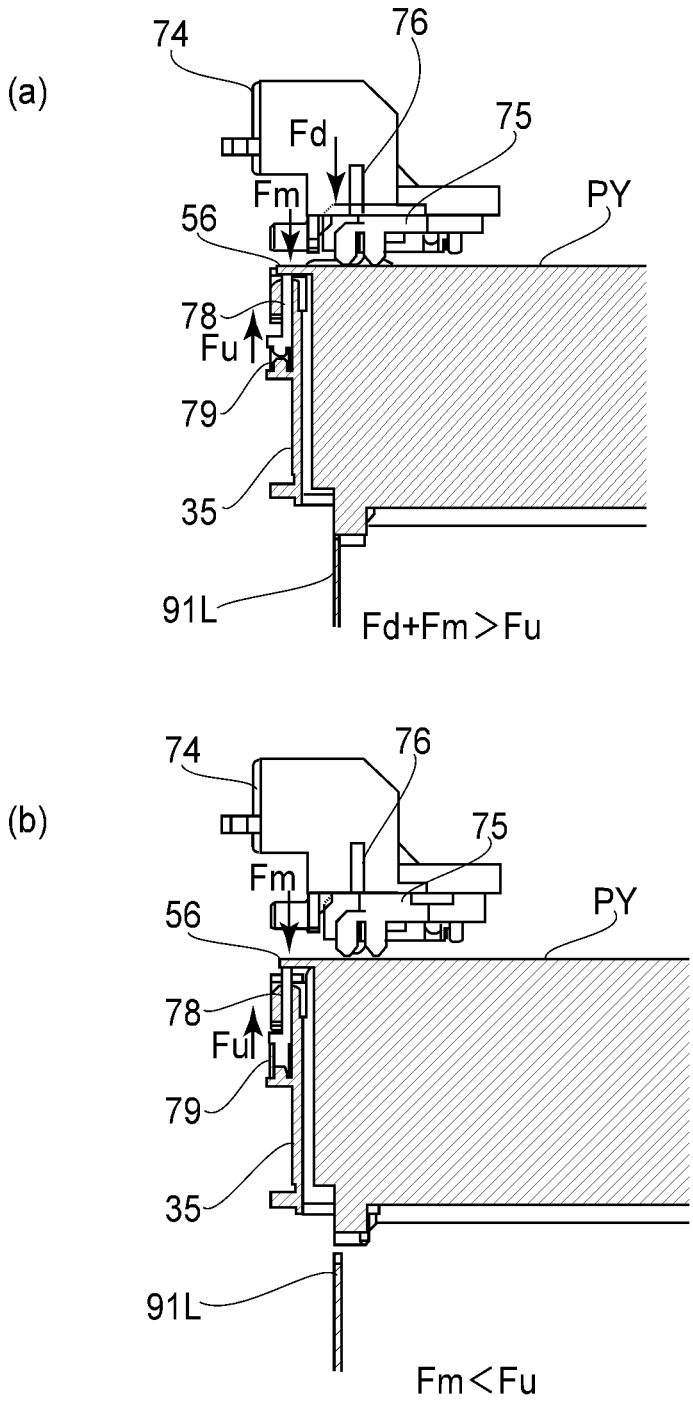
In FIG. 13, (a) is a sectional view, as seen from the front side of the main assembly in the state of (a) of FIG. 12, and (b) is a sectional view, as seen from the front side of the main assembly in the state of (b) of FIG. 12.

In the state shown in (a) of FIG. 12 and (a) of FIG. 13, the contact member 75 contacts to the cartridge PY to press the cartridge PY downwardly. The contact member 75 is urged downwardly by the spring 76. The urging force which depresses the cartridge PY from the contact member 75 is also Fd similarly to the urging member 71. The urging force which urges the cartridge PY upwardly Fu applied from the contact member 78 is set so as to be smaller than a resultant force of the urging force Fd which depresses the cartridge PY from the contact member 75 and the force Fm applied to the contact member 78 by the weight of the cartridge PY (Fd+Fm>Fu). For this reason, the left bearing portion 52 of the cartridge PY is pressed to (positioning portion 91*a* of the inner plate 91L) to position the center of the drum 1.

As described above, the cartridge PY is pressed by the urging forces of the spring 73 and the spring 76. By this, the bearing portions 51, 52 of the cartridge PY can be pressed to the positioning portions 91*a* of the inner plates 91L, 91R of the main assembly 100. Similarly, the projection 57 of the cartridge can be engaged with the groove 35*i* of the tray 35. By this, the position of each cartridge P in the latent image formation position is fixed.

Figure 7B:
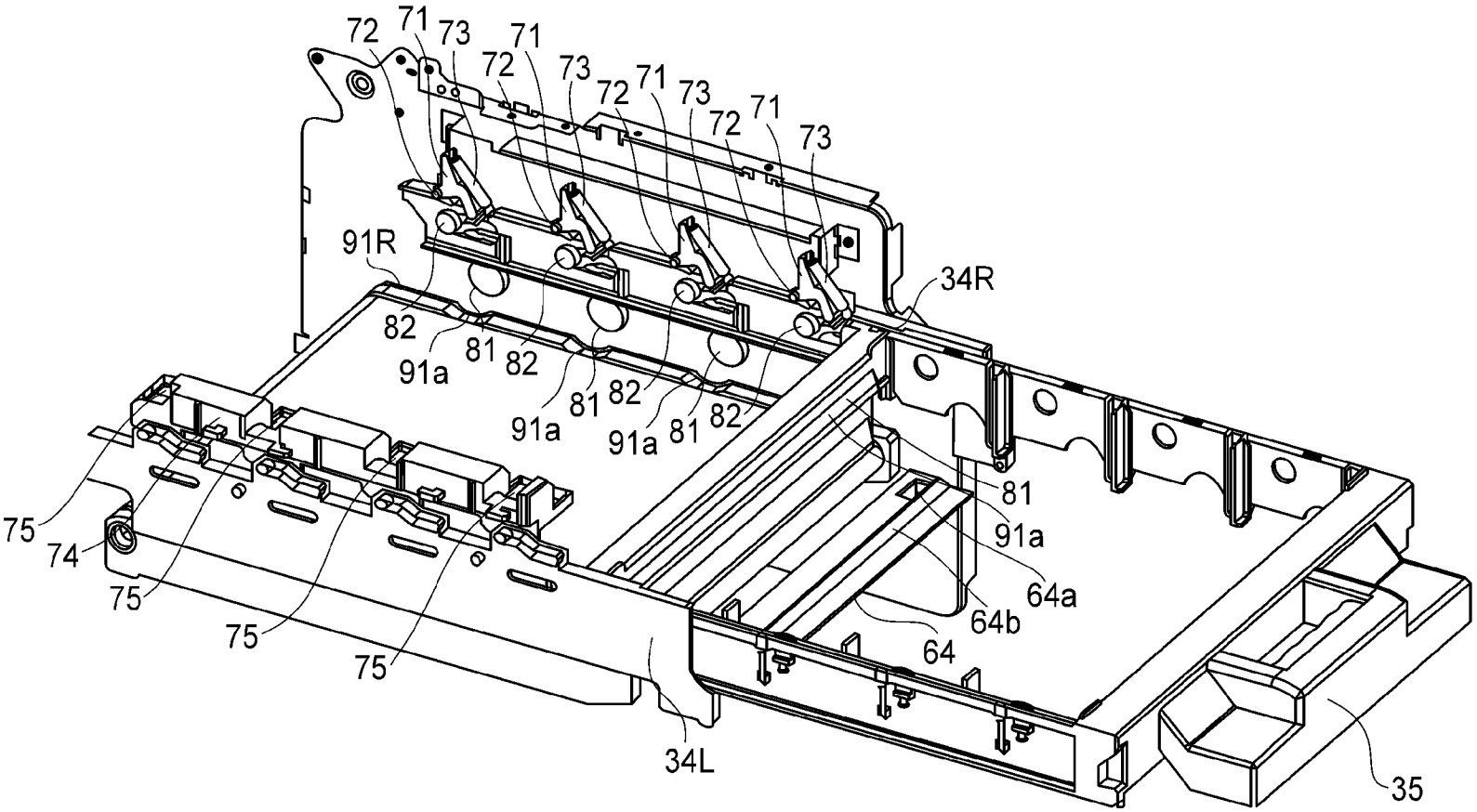
FIG. 7B is a perspective view illustrating the state that the door is opened from the state of FIG. 7A, and the tray is drawn out.

In FIG. 7B, the door 31 is opened from the state of FIG. 7A, and the tray 35 is drawn out. Part (b) of FIG. 8 is a partly enlarged view of the urging member 71 of FIG. 7B and the couplings 81, 82.

In the pressing released state non-pressing shown in (b) of FIG. 8, the lever part 71*a* of the urging member 71 is pushed up by the urging member raising portion 34*c* provided on the tray holding member 34R. In this manner, the pressing of the urging member 71 to cartridge P is released.

A drive releasing cam 83 is provided to be rotatable about the coupling 81. A cam 83 is provided with a projection 83*a* engaged with a tray holding portion 34. For this reason, in interrelation with the movement of the tray holding member 34R of the front-rear direction, the cam 83 rotates from the position of (a) of FIG. 8 about the coupling 81 to the position of FIG. 7B. The coupling 43 and the development drive coupling 39 PY are depressed to the position shown in FIG. 7B by the operation of the cam 83.

Part (b) of FIG. 9 is a partly enlarged view of the contact member 75 shown in FIG. 7B. The contact holding member 74 is provided with a projection 74*a*. The projection 74*a* is engaged with a groove 34*e* provided on the tray holding member 34L. For this reason, when the door 31 is opened from the state of (a) of FIG. 9 and the tray holding member 34L moves to the front, the inclined surface of the groove 34*e* pushes up the projection 74*a*. In this manner, the contact holding member 74 rises. When the contact holding member 74 rises by a predetermined amount, the contact holding member 74 pushes the contact member 75 up. In this manner, the electric power supply and pressing to cartridge P by the contact holding member 74 is released.

Figure 10B:
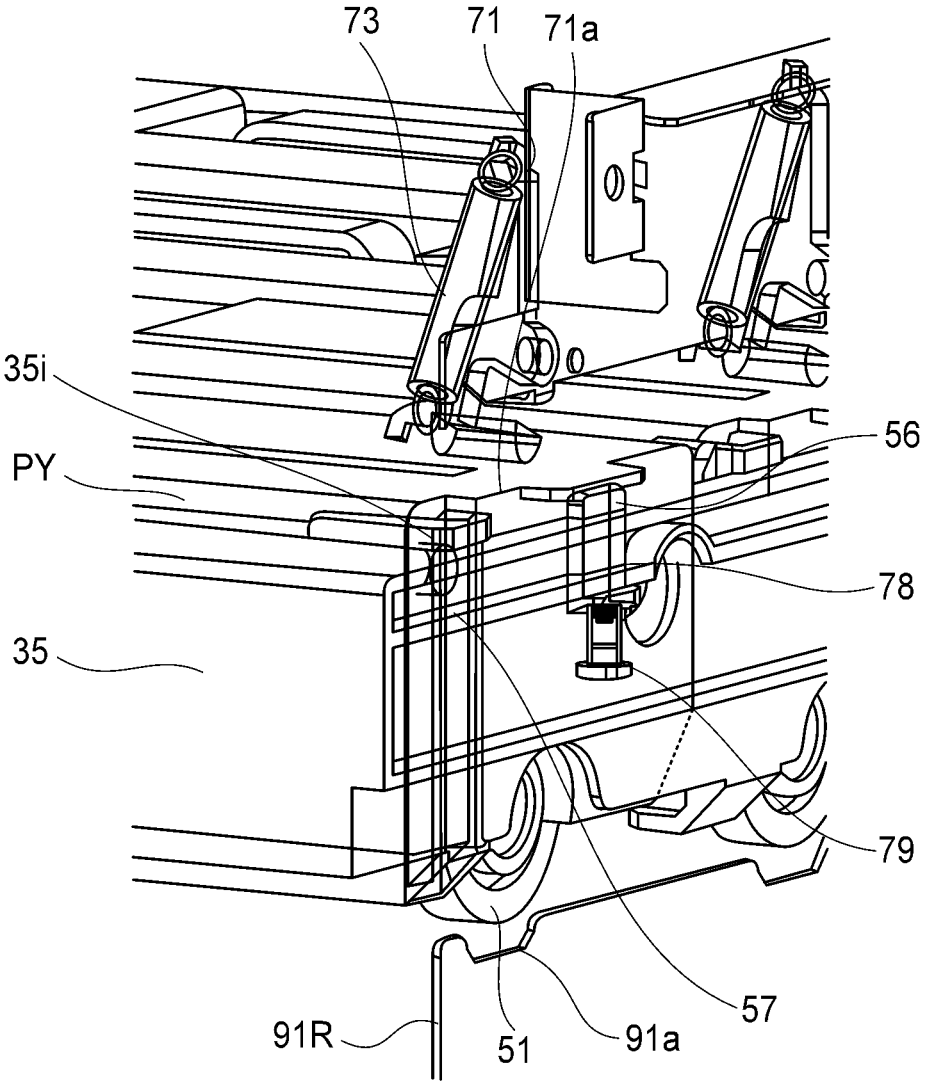
FIG. 10B is a perspective view of the cartridge, the tray, the urging member portion in the state where the door is opened from the state of FIG. 10A.

FIG. 10B is a fragmentary perspective view of the cartridge PY, the tray 35, and the urging member 71 in the state in which the door 31 is opened from the state of FIG. 10A (FIG. 5). (b) of FIG. 11 is a sectional view, as seen from the front side of the main assembly.

In the state shown in (b) of FIGS. 10B and 11, the urging member 71 spaces from the cartridge PY. The urging force which urges the cartridge PY upwardly Fu from the supporting spring 79 which is provided on the tray 35 is set so as to be larger than the force Fm applied to the contact member 78 by the weight of the cartridge (Fm<Fu). For this reason, the contact member 78 pushes the cartridge PY up by the predetermined amount.

Part (b) of FIG. 12 is a perspective view of the cartridge PY, the tray 35, and the urging member 71 in the state of FIG. 10B. (b) of FIG. 13 is a sectional view, as seen from the front side of the main assembly.

In the states shown in (b) of FIG. 12 and (b) of FIG. 13, the contact member 75 spaces from the cartridge PY. The urging force which urges the cartridge PY upward Fu from the spring 79 is set so as to be larger than the force Fm applied to the contact member 78 by the weight of the cartridge (Fm<Fu). For this reason, the contact member 78 pushes the cartridge PY up by the predetermined amount. The spring 79 is provided in the tray 35.

As described above, when the door 31 is opened, the pressing of the urging member 71 and the contact member 75 is released, in interrelation with the movement of the tray holding members 34L, 34R. Simultaneously, the connection of the coupling 81, 82 with the drive inputting portion of each cartridge P is released, so that the electrical connection from the electric power supply system of the main assembly to the electrical contact of each cartridge is shut off. In this manner, in interrelation with the tray holding members 34L, 34R, the pressing of each cartridge P is released. Thereafter, the urging force of the spring 79 raises the cartridge by the predetermined amount. Then, each cartridge P and the positioning portion 91*a* of the belts 13 and the plates 91L, 91R is spaced from each other. By this, the tray 35 is freely slidable. While carrying each cartridge P the tray 35 can be pushed in and drawn out relative to the main assembly.

Figure 14:
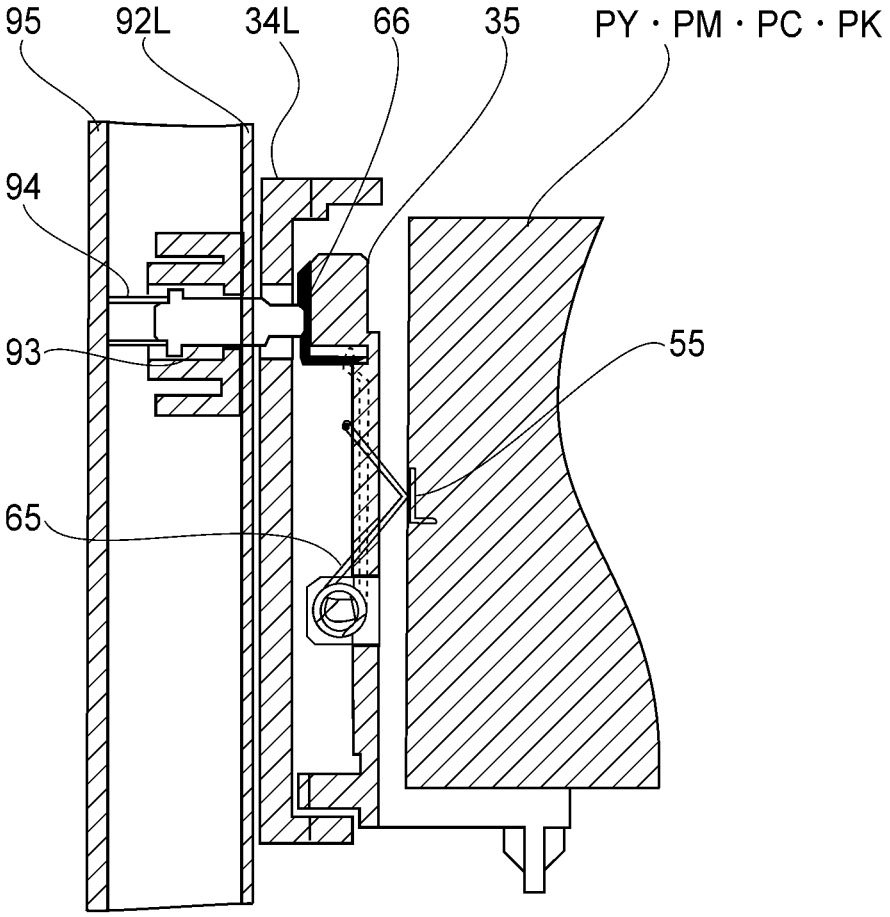
FIG. 14 is a fragmentary sectional view of the cartridge, the tray, a tray holding member, a main assembly side plate, a main assembly side electric power supply portion, as seen from the front side of the main assembly.

FIG. 14 illustrates the structure for supplying the electric power from the main assembly through an intermediate electrical contact provided on the tray 35 to each cartridge P. FIG. 14 is a fragmentary sectional view, as seen from the front side of the main assembly of each cartridge P, the tray 35, the tray holding member 34L, a main assembly side plate 92L, and a main assembly side electric power supply portion 95.

As shown in FIG. 14, the tray 35 is provided with a plurality of intermediate contact springs 65 which are arranged horizontally at the same level in the perpendicular direction. The end of the spring 65 is electrically connected to the electrical contact 55 of each cartridge P. The main assembly is provided with the contact pins 93 electrically connected through a main assembly electrical contact spring 94 with the main assembly side electric power supply portion 95 provided on the outside of a side plate 92L which is arranged horizontally at the same level in the perpendicular direction. A pin 93 projects toward the tray (35) through the holes formed in the side plate 92L and the tray holding member 34L. <0470>

As shown in FIG. 14, the pin 93 and the spring 65 are electrically connected with each other through the intermediate contact plate 66. The spring 65 is contacted in the transverse direction to the electrical contact 55 of each cartridge P, and is connected electrically.

As described above, when the door 31 is closed, cartridge P is assuredly fixed to the main assembly positioning portion. When the door 31 is opened, the urging forces of the positioning urge means and the spacing and urging means are set, so that the cartridge P rises by the predetermined amount from the tray 35. By this, the cartridge P can be spaced from the positioning portion only by the operation of opening the door 31 without using a complicated mechanism. For this reason, cartridge P can be spaced from a cartridge positioning portion in the main assembly and from the belt member without moving the tray 35 itself in the up-down direction. The tray 35 can horizontally be drawn out of the main assembly. Therefore, the operating forces for the door 31 and the tray 35 required of the user can be reduced, and the flaw and the memory due to the rubbing between the drum 1 and the belt 13 can be prevented. When the user carries out the exchange of the cartridge and the jam clearance operation, the operation for the movement of the tray 35 is easy, and the operativity of the maintenance is improved.

<Second Embodiment>

In the second embodiment, the spacing and urging means functions also as the electric power supply means for the cartridge. The structures of the main assembly in the second embodiment are similar to those of the first embodiment described above. These embodiments are different only in the structures of the tray 35 and each cartridge P. Therefore, the description with respect to the structure of the main assembly is omitted.

Figure 15A:
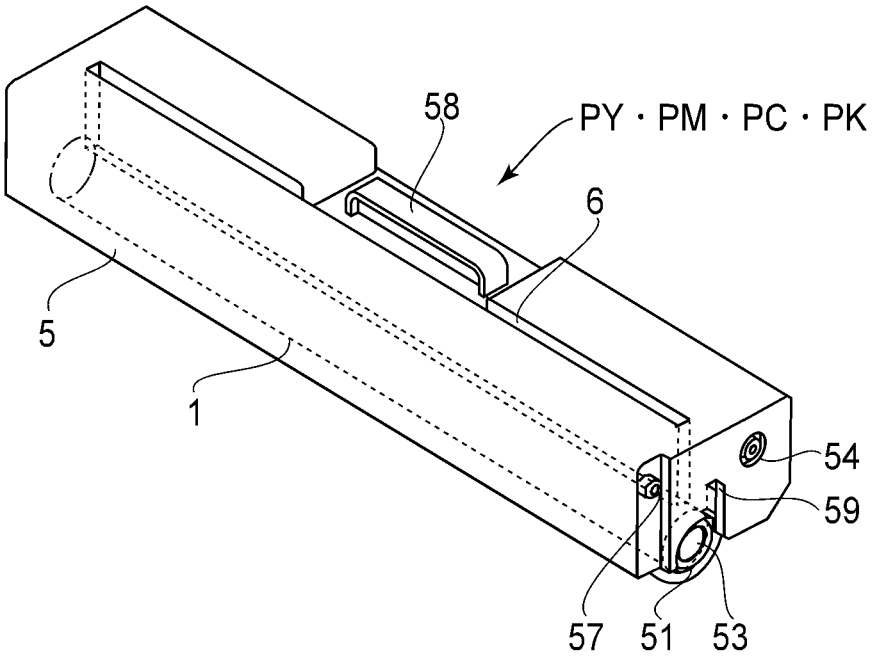
FIG. 15A shows an outer appearance perspective view of a cartridge according to the second embodiment of the present invention, as seen from the driving side.
Figure 15B:
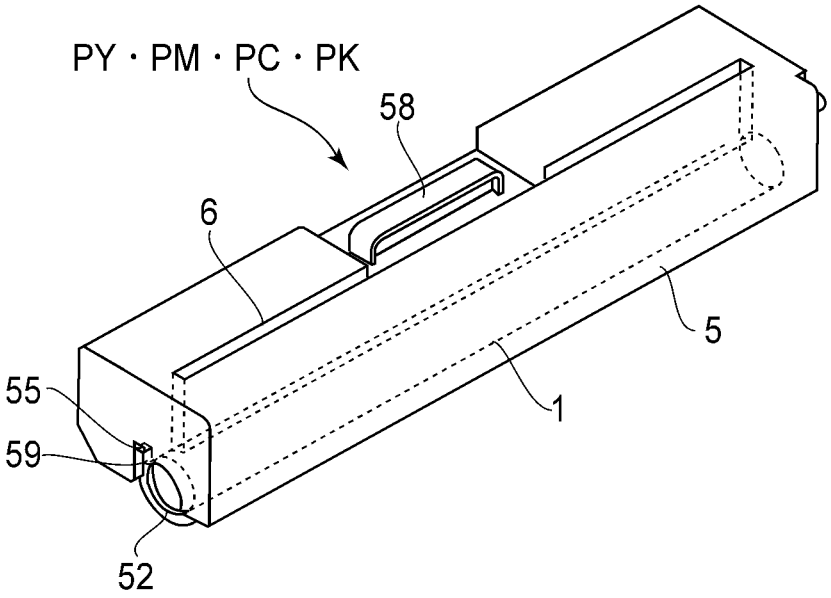
FIG. 15B shows an outer appearance perspective view of a cartridge according to the second embodiment of the present invention, as seen from the non-driving side.

The FIG. 15A and FIG. 15B are outer appearance perspective views of cartridge P. FIG. 15A shows a perspective view of cartridge P, as seen from the driving side, and FIG. 15B shows a perspective view of cartridge P, as seen from the non-driving side. The right side surface portion and the left side surface portion of cartridge P are provided with the grooves 59 engaged with the intermediate contact spring 65 and a supporting spring 80 provided on the tray 35. Furthermore, the top surface of the groove 59 of the left side surface portion is provided with the electrical contact 55. The other structures are the structure similar to those of the first embodiment.

Figure 16A:
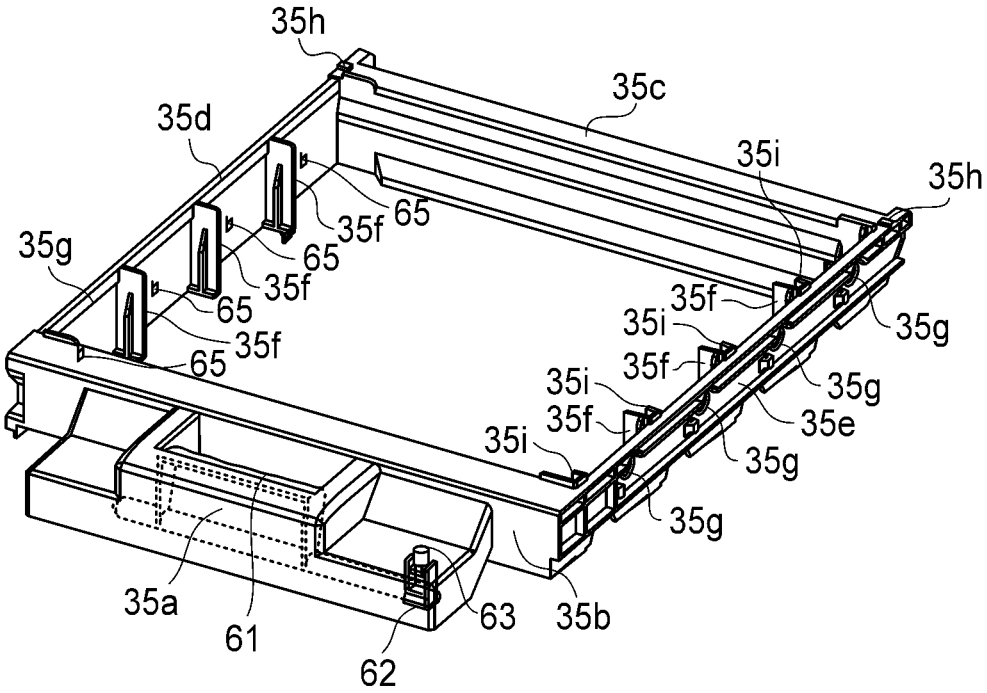
FIG. 16A shows an outer appearance perspective view of a cartridge according to the second embodiment of the present invention, as seen from the driving side.
Figure 16B:
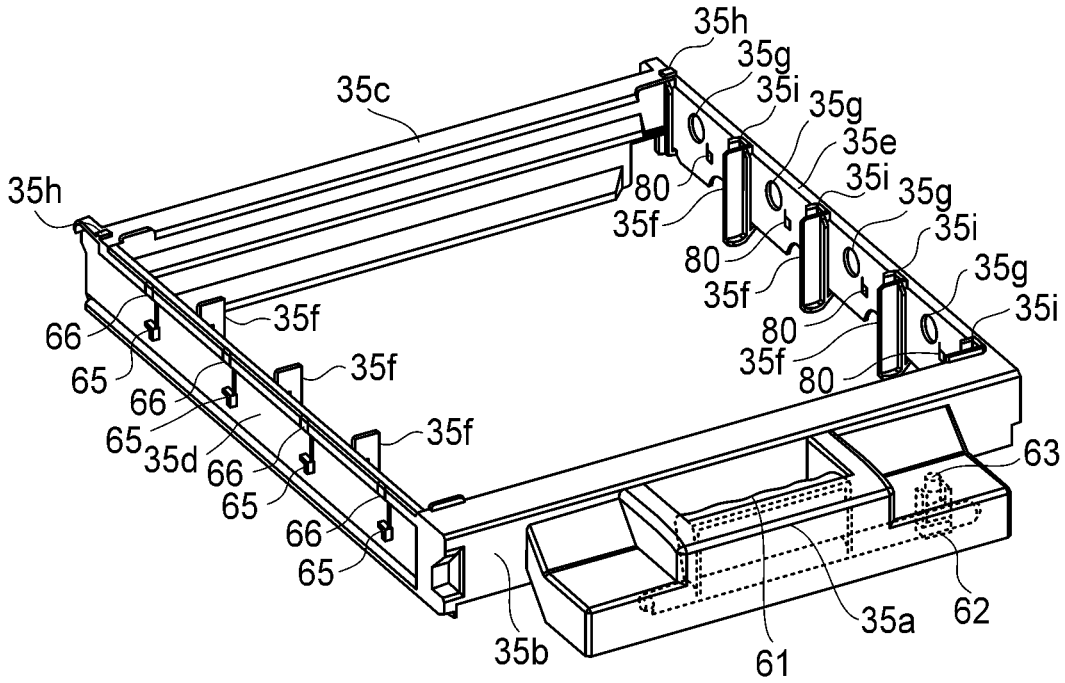
FIG. 16B shows an outer appearance perspective view of a cartridge according to the second embodiment of the present invention, as seen from the non-driving side.
Figure 17:
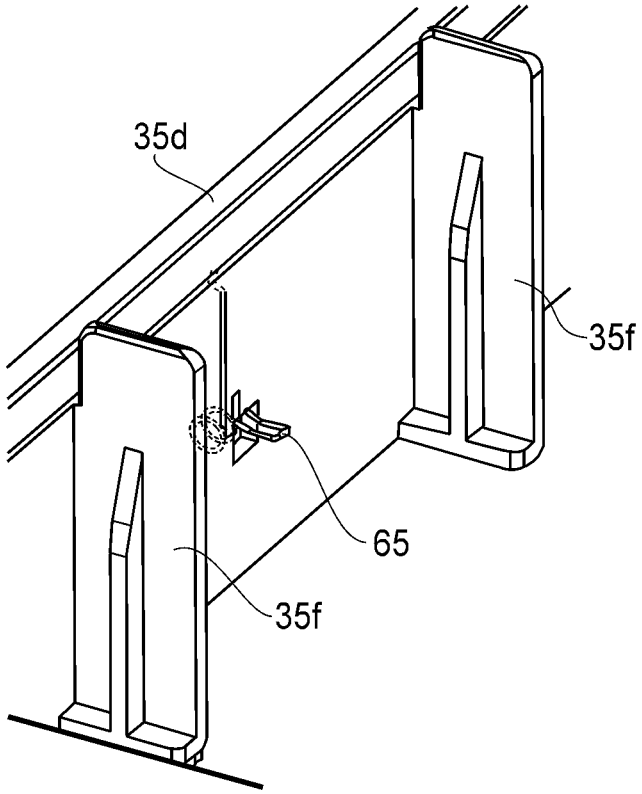
In FIG. 17, (a) is an enlarged view of an intermediate contact spring portion, and (b) is an enlarged view of a supporting spring portion.
Figure 17:
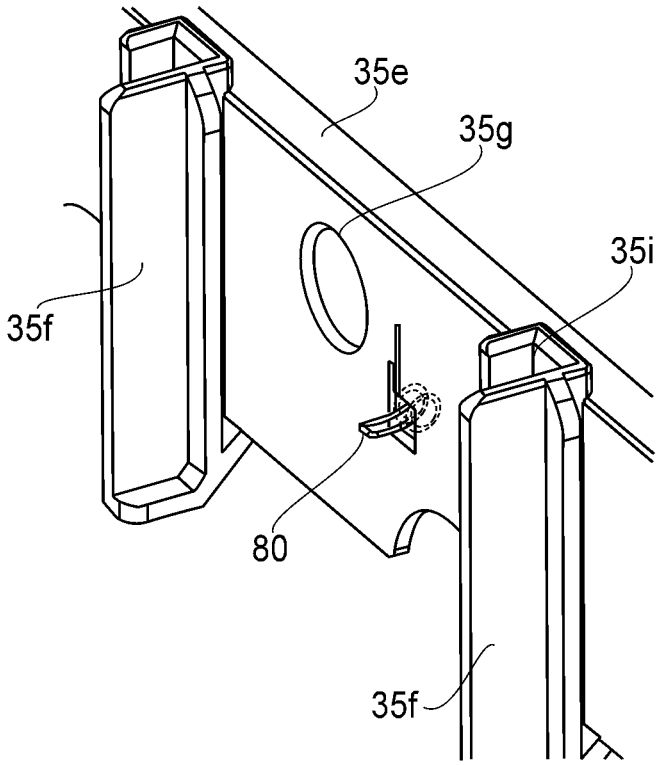

FIG. 16A and FIG. 16B are the outer appearance perspective views of the tray. FIG. 16A is a perspective view of the tray, as seen from the driving side. FIG. 16B is a perspective view of the tray, as seen from the non-driving side. As contrasted to the first embodiment, the spring 65 contacts downwardly not laterally. The right frame part 35*e* of the tray 35 is provided with a supporting spring 80 contacted to cartridge P downwardly, similarly to the spring 65. Therefore, frame parts 35*d* and 35*e* are not provided with any supporting member for supporting cartridge P other than The springs 65, 80. Part (a) of FIG. 17 is a partly enlarged view of a spring 65, and part (b) of FIG. 17 is a partly enlarged view of the spring 80. The other structures are similar to those of the first embodiment.

Figure 18:
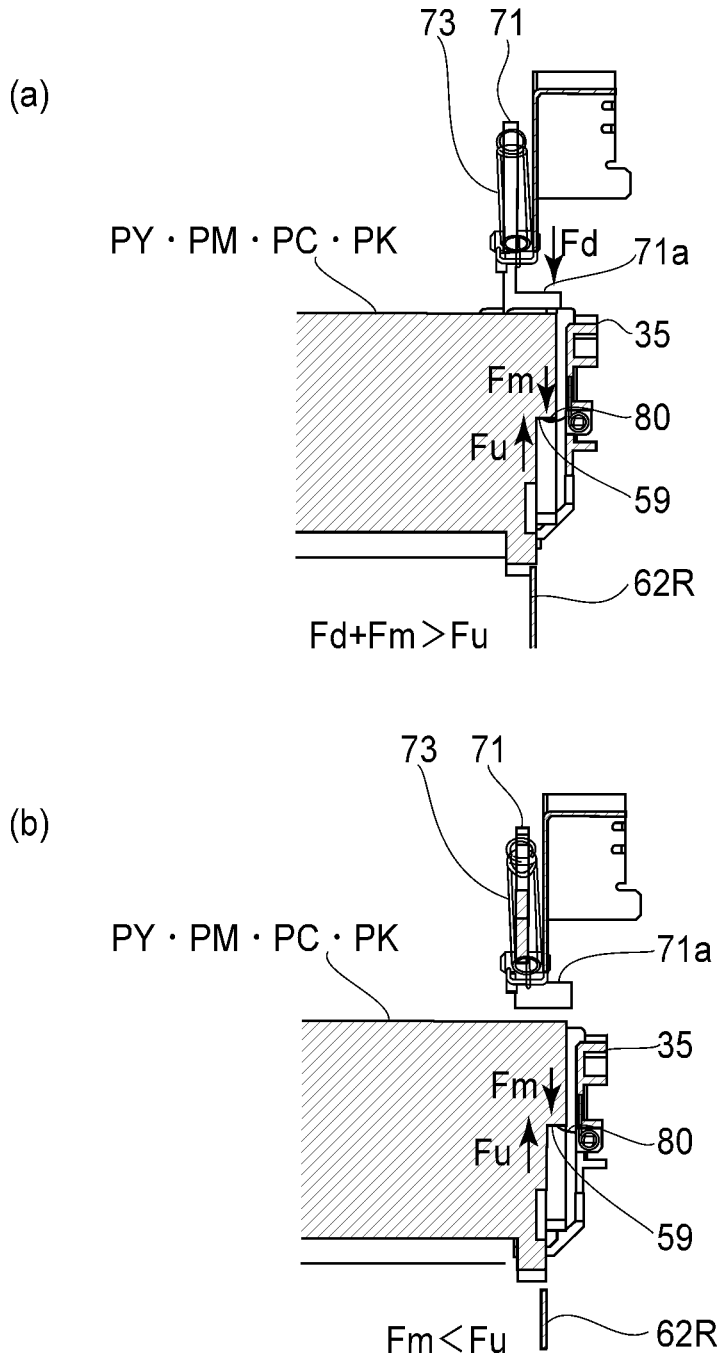
In FIG. 18, (a) is a fragmentary sectional view of the cartridge, the tray, the urging member in the state that the tray carrying the cartridge resides in the main assembly and the door is closed, as seen from the front side of the main assembly, and (b) is a fragmentary sectional view of the cartridge, the tray, a contact holding member, as seen from the front side of the main assembly.

Part (a) of FIG. 18 is a fragmentary sectional view, as seen from the front side of the main assembly of each cartridge P, the tray 35, and the urging member 71 in the state that the tray 35 carrying cartridge P is in the main assembly, and that the door 31 is closed (FIG. 1). Part (a) of FIG. 19 is a fragmentary sectional view, as seen from the front side of the main assembly of each cartridge P, the tray 35, and the contact holding member 74 in the state that the door 31 is opened from the state in (a) of FIG. 18.

In the state shown in (a) of FIG. 18, the urging member 71 contacts with each cartridge P, and presses each cartridge P downwardly. The urging force which urges cartridge P upwardly Fu from a spring 80 is set so as to be smaller than the resultant force of the urging force Fd which pushes the cartridge down from the spring 73 and the force Fm applied to the spring 80 by the weight of the cartridge (Fd+Fm>Fu). The right bearing 51 of each cartridge P is pressed to the positioning portion 91*a* provided in a plate 91R to position the center of the drum 1.

Figure 19:
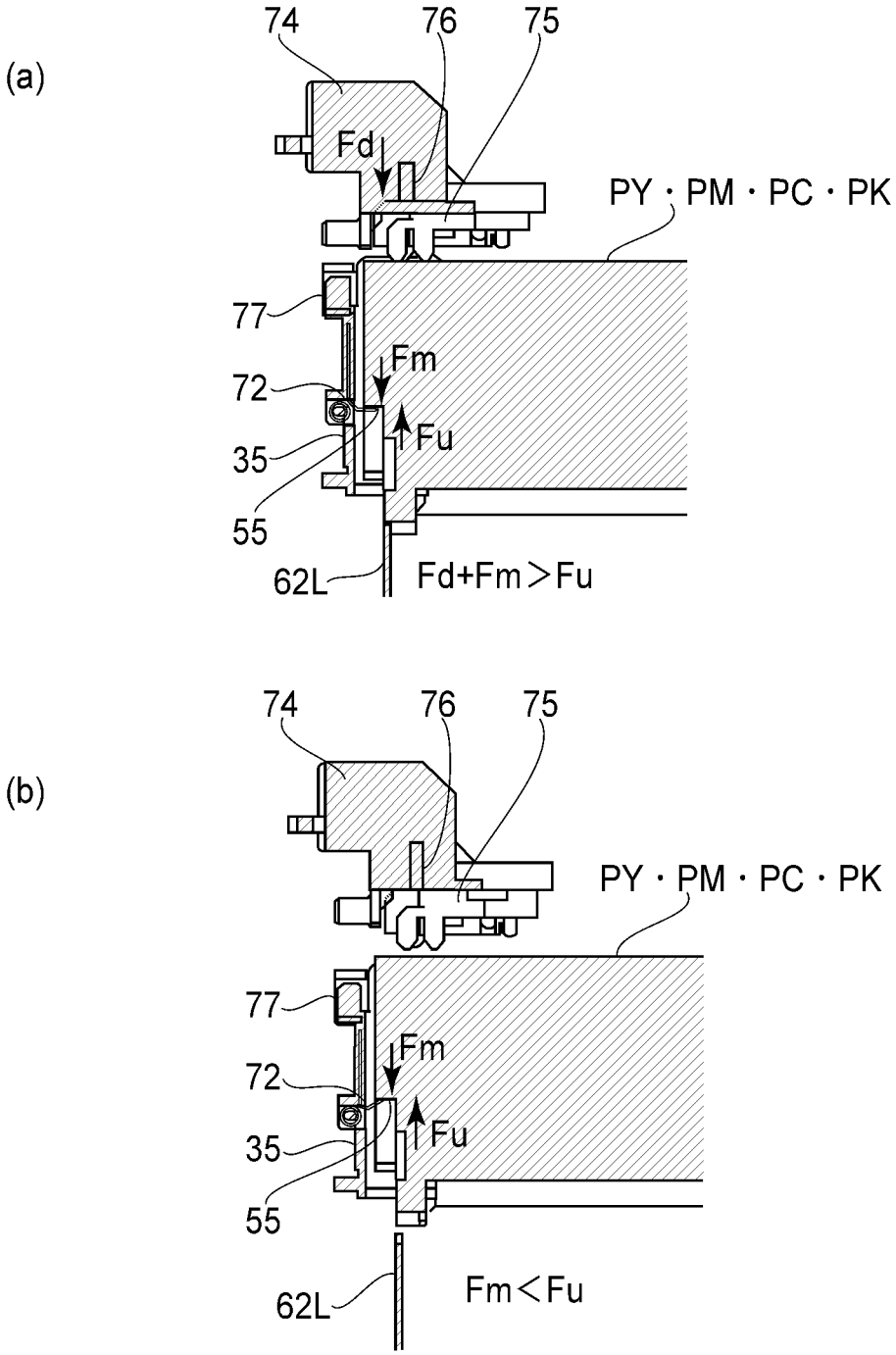
In FIG. 19, (a) is a fragmentary sectional view of the cartridge, the tray, the contact holding member in the state where the door is opened from the state of (a) of FIG. 18, as seen from the front side of the main assembly, and (b) is a fragmentary sectional view of the cartridge, the tray, the contact holding member in the state that the door is opened from the state of (b) of FIG. 18, as seen from the front side of the main assembly.

In the state shown in (a) of FIG. 19, the urging member 71 spaces from each cartridge P. The urging force which urges cartridge P upwardly Fu from the spring 80 is set so as to be larger than the force Fm applied to the supporting spring 80 by the weight of cartridge P (Fm<Fu). For this reason, the spring 80 pushes the cartridge P up by the predetermined amount.

Part (b) of FIG. 18 is a fragmentary sectional view, as seen from the front side of the main assembly of each cartridge P, the tray 35, and the contact holding member 74 in the state that the tray 35 supporting cartridge P is pushed in the main assembly and the door 31 is closed (FIG. 1). Part (b) of FIG. 19 is a fragmentary sectional view, as seen from the front side of the main assembly of each cartridge P, the tray 35, and the contact holding member 74 in the state that the door 31 is opened from the state shown in (b) of FIG. 18 and is.

In the state shown in (b) of FIG. 18, the contact member 75 contacts with each cartridge P, and presses each cartridge P downwardly. The contact member 75 is urged downwardly by the spring 76. The urging force Fu which urges cartridge P upwardly from the spring 65 is set so as to be smaller than the resultant force of the urging force Fd which pushes cartridge P down by the spring 76 and the force Fm applied to the spring 65 by the weight of cartridge P (Fd+Fm>Fu). For this reason, the left bearing portion 52 of each cartridge P is pressed to the positioning portion 91*a* to position the center of the drum 1. The positioning portion 91*a* is provided in Plate 91L.

In the state shown in (b) of FIG. 19, the contact member 75 spaces from each cartridge P. The urging force Fu which urges cartridge P upwardly from the spring 65 is set so as to be larger than the force Fm applied to the spring 65 by the weight of cartridge P (Fm<Fu). For this reason, the spring 65 pushes each cartridge P up by the predetermined amount.

The cartridge P is directly supported by the springs 65, 80. In this manner, similarly to the first embodiment, the cartridge P can be spaced from the positioning portion 91*a* and the belt 13, without moving the tray 35 to the up-down direction. And, as compared with the first embodiment, the structure of the tray 35 is simplified and a cost is reduced.

<Other Embodiment>

In the embodiment described above, the intermediary transfer member which carries the toner image is used as the belt member to which said cartridge contacts and from which it is spaced. More specifically, the intermediary transfer member is used and the different color toner images are sequentially transferred superimposedly onto the intermediary transfer member. The image forming apparatus has been exemplified in which the toner image carried on the intermediary transfer member is transferred all together onto the recording material. However, the present invention is not limited to this. The belt member relative to which the cartridge contact and space may be a recording material carrying member which carries and feeds the recording material. More specifically, the recording material carrying member may be used. The different color toner image is sequentially transferred superimposedly onto the recording material carried on the recording material carrying member. The present invention is applied to such an image forming apparatus with the similar effects.

In the embodiment described above, the tray holding member is operated interrelatedly with the opening and closing operation of the door. The structure for the contacting and spacing of the urging member, the contact member, and the drive coupling relative to each cartridge by the movement of the tray holding member has been exemplified. However, the present invention is not limited to this. For example, it may be that the tray holding member is fixed, and the urging member, the contact member, and the drive coupling are coupled with the door by another means to carry out the contacting and spacing.

In the embodiments described above, the tray 35 is horizontally moved along an installation surface (unshown) of the main assembly 100. However, this embodiment is not limited to this example, and the tray 35 may be moved linearly in the angularly upward direction or in the angularly downward direction relative to the installation surface (unshown) of the main assembly 100, for example. The tray 35 is moved linearly in the direction perpendicular to the longitudinal direction of the cartridge therein. The longitudinal direction of the cartridge is parallel to the axial direction of the photosensitive drum 1 or the axial direction of a developing roller.

In the embodiments described above, a cartridge mounting and dismounting position is the position in which the cartridge is mounted and demounted relative to the tray 35. The cartridge mounting and dismounting position is in the downstream side with respect to the drawing-out direction of the tray than the position in the case of the cartridges being in the image forming position. In these embodiments, the cartridge mounting and dismounting position is the position in which the user can take the cartridge out of the tray 35 outside of the main assembly 100. The cartridge mounting and dismounting position is the position in which the user can place the cartridge on the tray 35 from the outside of the main assembly 100. Therefore, the cartridge mounting and dismounting position may not be limited to the outside of the main assembly 100, but it may be inside of the main assembly 100 if the cartridge can be mounted and demounted relative to the tray 35.

According to the embodiments described above, the tray 35 is movable linearly in the direction perpendicular to the longitudinal direction of the cartridge relative to the main assembly. However, the tray 35 may be movable linearly in the direction in parallel with the longitudinal direction of the cartridge relative to the main assembly.

In the embodiments described above, the tray 35 may be able to be dismounted from the main assembly by releasing a stopper (unshown).

In the embodiments described above, although the image forming apparatus has been described as being a printer, the present invention is not limited to this example. For example, it may be another image forming apparatus such as a copying machine, a facsimile device, or a composite machine having these functions. The present invention is applicable to these image forming apparatuses with the similar effects. According to the embodiments described above, the positioning of cartridge P relative to the main assembly 100 can be released only by the operation which opens the door 31, without using the complicated mechanism. The cartridge P can be spaced from the positioning portion 91*a* provided in the main assembly. In that case, the cartridge P released in the positioning is spaced from the positioning portion 91*a* by the urging force of the spring (spacing and urging means) 79. For this reason, it is not necessity that the tray 35 is moved in the direction of the contacting and spacing between the cartridge P and the positioning portion of the main assembly 100. For the operation of the door 31, the large force is not required. By this, when the user carries out the exchange of cartridge P and the jam clearance operation, the tray 35 is moved easily. Thus, the operativity of the maintenance is improved.

While the invention has been described with reference to the structures disclosed herein, it is not confined to the details set forth, and this application is intended to cover such modification or changes as may come within the purposes of the improvements or the scope of the following claims.

This application claims priority from Japanese Patent Application No. 067350/2009 filed Mar. 19, 2009 which is hereby incorporated by reference.

What is claimed is:

1. A color electrophotographic image forming apparatus for forming an image on a recording material, wherein a plurality of cartridges are detachably mountable to a main assembly of the color electrophotographic image forming apparatus, said color electrophotographic image forming apparatus comprising:

a cartridge supporting member movable between an inside position inside of said main assembly of the apparatus while supporting said cartridges and an outside position outside of said main assembly of the apparatus, said cartridge supporting member being provided with an accommodating portion, surrounded by a frame, for accommodating said cartridges;

an opening for permitting said cartridge supporting member to move between the inside position and the outside position;

an openable member movable between a closed position for closing said opening and an open position for opening said opening;

a plurality of positioning urging means that (i) urge said cartridges to positioning portions of said main assembly of the apparatus, respectively, with closing of said openable member, and (ii) release said cartridges from the urging with opening of said openable member; and a plurality of spacing urging means that urge said cartridges in a direction of spacing from the positioning portion, respectively, wherein urging forces of said plurality of spacing urging means are smaller than combined urging forces of said plurality of positioning urging means and forces applied to said plurality of spacing urging means by weights of said cartridges, respectively, and wherein the urging forces of said plurality of spacing urging means are larger than the forces applied to said plurality of spacing urging means by the weights of said cartridges, respectively, and wherein said plurality of spacing urging means are provided outside of said frame with respect to a direction crossing with a direction of movement of said cartridge supporting member.

2. The color electrophotographic image forming apparatus according to claim 1, further comprising a belt member for carrying and feeding a toner image or a recording material, and wherein said plurality of positioning urging means urge said cartridges toward said belt member, and said plurality of spacing urging means urges said cartridges away from said belt member.

3. The color electrophotographic image forming apparatus according to claim 1, wherein said plurality of positioning urging means each function also as an electric energy supply means for said cartridges.

4. The color electrophotographic image forming apparatus according to claim 1, wherein said cartridges each include as a unit an electrophotographic photosensitive member drum and process means including at least one of charging means, developing means, and cleaning means.

5. The color electrophotographic image forming apparatus according to claim 4, wherein the direction crossing with the direction of movement of said cartridge supporting member is an axial direction of said electrophotographic photosensitive member drum.

6. The color electrophotographic image forming apparatus according to claim 1, wherein said cartridges each include a developing roller for developing an electrostatic latent image formed on an electrophotographic photosensitive drum, and said cartridges accommodate a developer to be used by said developing roller, and wherein said electrophotographic photosensitive member drums are provided in said main assembly of the apparatus, in said cartridge supporting member, or in said cartridges.

7. The color electrophotographic image forming apparatus according to claim 1, wherein said plurality of spacing urging means includes (i) contact members contactable to said cartridges and movably supported by said cartridge supporting member and (ii) springs urging said contact members, wherein said springs are provided with supplying portions for urging said contact members at one longitudinal end portions and supported portions supported by the frame at the other longitudinal end portions.

* * * * *